US011005182B2

(12) United States Patent
Kowaita et al.

(10) Patent No.: US 11,005,182 B2
(45) Date of Patent: May 11, 2021

(54) PATCH ANTENNA

(71) Applicant: YOKOWO CO., LTD., Tokyo (JP)

(72) Inventors: Kazuhiro Kowaita, Tomioka (JP); Takashi Kaneko, Tomioka (JP); Bunpei Hara, Tomioka (JP)

(73) Assignee: YOKOWO CO. , LTD., Tokyo (JP)

( * ) Notice: Subject to any disclaimer, the term of this patent is extended or adjusted under 35 U.S.C. 154(b) by 21 days.

(21) Appl. No.: 16/275,359

(22) Filed: Feb. 14, 2019

(65) Prior Publication Data

US 2019/0280386 A1 Sep. 12, 2019

(30) Foreign Application Priority Data

Mar. 8, 2018 (JP) ..... JP2018-042181

(51) Int. Cl.

| | |
|---|---|
| ***H01Q 1/32*** | (2006.01) |
| ***H01Q 9/04*** | (2006.01) |
| ***H01Q 1/38*** | (2006.01) |
| ***H01Q 1/48*** | (2006.01) |
| *H01Q 1/42* | (2006.01) |

(52) U.S. Cl.

CPC ..... *H01Q 9/0421* (2013.01); *H01Q 1/3275* (2013.01); *H01Q 1/38* (2013.01); *H01Q 1/48* (2013.01); *H01Q 1/42* (2013.01)

(58) Field of Classification Search

CPC .. H01Q 1/38; H01Q 1/42; H01Q 1/48; H01Q 1/1214; H01Q 1/3275; H01Q 9/0407; H01Q 9/0421

See application file for complete search history.

(56) References Cited

U.S. PATENT DOCUMENTS

| | | | | |
|---|---|---|---|---|
| 10,096,893 | B2 * | 10/2018 | Ameri | H01Q 9/0414 |
| 2004/0201523 | A1 * | 10/2004 | Yuanzhu | H01Q 21/29 343/700 MS |
| 2005/0219131 | A1 * | 10/2005 | Haidacher | H01Q 1/42 343/725 |
| 2007/0216597 | A1 * | 9/2007 | Fujimoto | H01Q 19/005 343/853 |
| 2009/0174616 | A1 * | 7/2009 | Kim | H01Q 1/36 343/711 |
| 2010/0073236 | A1 * | 3/2010 | Mierke | H01Q 9/0414 343/700 MS |

(Continued)

FOREIGN PATENT DOCUMENTS

JP 2017-191961 A 10/2017

*Primary Examiner* — Tung X Le
(74) *Attorney, Agent, or Firm* — Xsensus LLP

(57) ABSTRACT

A patch antenna is provided with an antenna main body including a radiating element on an upper surface of a dielectric body; and a parasitic element disposed at a predetermined distance from the radiating element. The parasitic element is a metal material having an upward convex shape as a whole and including a planar portion which is parallel to the upper surface of the radiating element and two bent portions which are inclined portions inclined from both ends of the planar portion toward the radiating element. While the parasitic element has a three-dimensional shape as a whole, the parasitic element has a planar-view area wider than a planar-view area of the radiating element in a planar view as seen from the first surface side of the dielectric body, and is provided in a position apart from the radiating element and to cover the radiating element.

21 Claims, 17 Drawing Sheets

(56) References Cited

U.S. PATENT DOCUMENTS

| | | | | |
|---|---|---|---|---|
| 2015/0123865 | A1* | 5/2015 | Dobric | H01Q 19/005 343/833 |
| 2016/0104932 | A1* | 4/2016 | Aminzadeh | H01Q 1/42 343/872 |
| 2018/0301796 | A1* | 10/2018 | Yamase | H01Q 1/3275 |

* cited by examiner

PATCH ANTENNA

This patent application is based on Japanese Patent Application No. 2018-42181 filed on Mar. 8, 2018, the contents of which are incorporated herein by reference.

BACKGROUND OF THE INVENTION

Field of the Invention

A patch antenna is known as a planar antenna provided with a radiating element having a small area in a quadrangular or circular shape. As a configuration to improve an antenna gain of the patch antenna, for example, as disclosed in JP-A-2017-191961, there is known a configuration in which a thin plate-like parasitic element (corresponding to a stack type parasitic element 38) is provided so as to face a radiating element.

However, the patch antenna is not commercialized in an exposed state, but is commercialized as accommodated in a case. When the parasitic element is disposed, a total size of the patch antenna is large as compared with when no parasitic element is disposed, and this may limit the design of the case. For example, when no parasitic element is disposed, the profile shape of the entire patch antenna is a substantially rectangular parallelepiped shape. In contrast, when the thin plate-like parasitic element is disposed so as to face the radiating element as in JP-A-2017-191961, the profile shape is a substantially rectangular parallelepiped shape enlarged by a space for disposing the parasitic element. In terms of the shape of the case for accommodating the patch antenna, there are limits on the design of the case due to the need for ensuring the space for the enlarged substantially rectangular parallelepiped shape.

BRIEF SUMMARY OF INVENTION

The present disclosure relates to a patch antenna comprising: a parasitic element; a dielectric body provided with a first surface facing to the parasitic element; and a radiating element provided on the first surface, wherein the parasitic element includes a three-dimensionally shaped metal material having a planar-view area wider than a planar-view area of the radiating element in a planar view as seen from the first surface side of the dielectric body, and is provided in a position apart from the radiating element and to cover the radiating element in a planar view.

DESCRIPTION OF EXEMPLARY EMBODIMENTS

Figure 1:
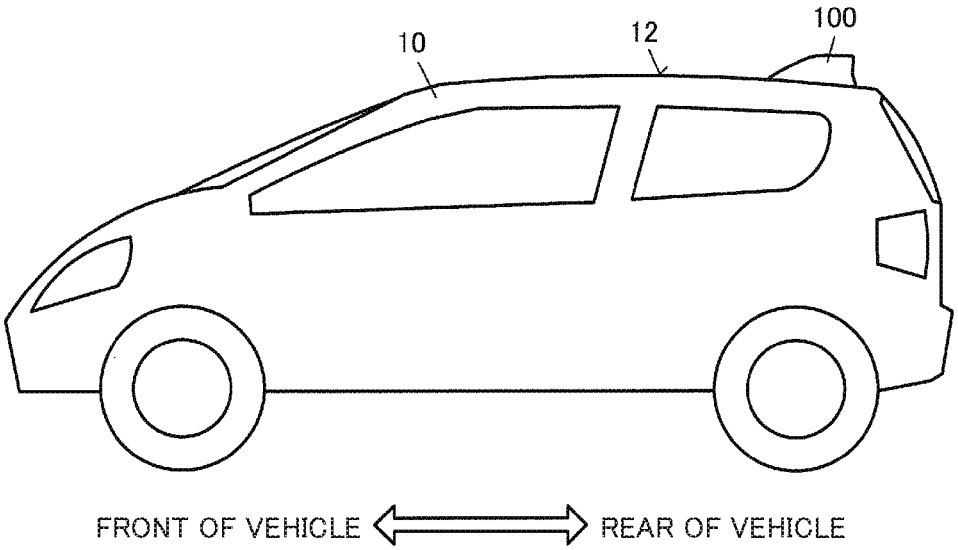
FIG. 1 is a conceptual view illustrating an example of use of an antenna device.

The following disclosure provides many different embodiments and examples for implementing different features of the provided subject matters. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Further, when a first element is described as being "connected" or "coupled" to a second element, such description includes embodiments in which the first and second elements are directly connected or coupled to each other, and also includes embodiments in which the first and second elements are indirectly connected or coupled to each other with one or more other intervening elements in between.

Detailed exemplary embodiments are described below with reference to the drawings.

First Embodiment

Antenna Device

Figure 2:
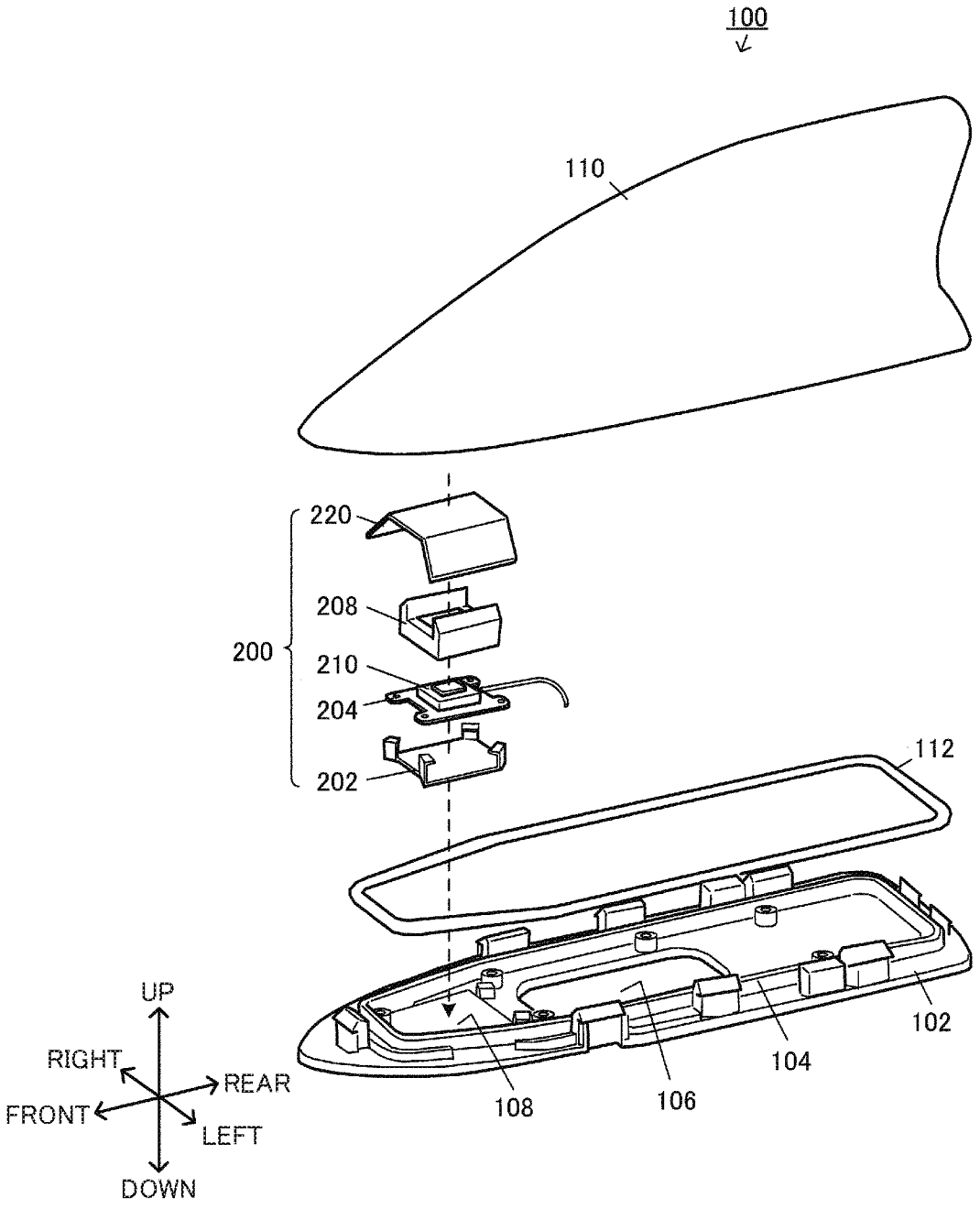
FIG. 2 is an exploded perspective view illustrating a configuration example of the antenna device.

FIG. 1 is a conceptual view illustrating an example of use of an antenna device 100 in a first embodiment. FIG. 2 is an exploded perspective view illustrating a configuration example of the antenna device 100. However, in FIG. 2, only a main part according to the first embodiment is illustrated, and the other elements are simplified or omitted. The antenna device 100 in the first embodiment is an antenna device for vehicle to be mounted on a roof 12 of a vehicle 10 such as a car, a truck, or an agricultural machine. The antenna device 100 is long in a front-rear direction as a whole, has a flat mounting surface, has a horizontal width that decreases toward the top, and is formed in a so-called shark fin shape which seems to be a fin of a shark or a dolphin in side view. The antenna device 100 is mounted on the upper surface of the roof 12 with its longitudinal direction along the front-rear direction of the vehicle 10. The "front-rear, horizontal, and perpendicular" directions of the antenna device 100 are assumed to be the same as the front-rear, horizontal, and perpendicular directions of the vehicle 10 on which the antenna device 100 is mounted. The direction to the front of the antenna device 100 is the forward direction of the vehicle 10, the direction to the rear of the antenna device 100 is the rearward direction of the vehicle 10, the horizontal direction of the antenna device 100 is the horizontal direction of the vehicle 10, and the perpendicular direction of the antenna device 100 is the vertical direction for the vehicle 10. In FIG. 2, the front-rear direction of the antenna device 100 is the front-rear direction along an appearance of a streamline shape of an antenna case 110, and the relatively tapered side is taken as the front of the antenna device 100, while the side opposite thereto is taken as the rear of the antenna device 100. The surface side for mounting on a roof 12 is taken as the lower side, and the side opposite thereto is taken as the upper side. The horizontal direction corresponds to the horizontal direction of the vehicle 10, the right side of the front of the antenna device 100 is in the right-hand side, and the left side thereof is in the left-hand side.

The antenna device 100 includes an antenna base 102 and the antenna case 110 that covers over the antenna base 102 and is molded using a synthetic resin with radio-wave transmittance. An accommodation space is defined between the antenna base 102 and the antenna case 110, and in this accommodation space, an antenna element and a substrate having various circuits for an antenna built thereon are stored. The constituents stored in the accommodation space are not limited thereto, but can be selected as appropriate.

The antenna base 102 is a plate-like body molded using a non-conductive synthetic resin, to be the bottom surface of the antenna device 100. In the antenna base 102, a rib 104 higher than an outer edge is formed on a little inside of the outer edge. An O-ring 112 that is a flexible insulator is sandwiched and fixed between the outside of the rib 104 and an inner wall of an inner case, not illustrated, thereby ensuring dustproof and waterproof properties inside the antenna device 100.

Inside the rib 104 of the antenna base 102, a penetration portion 106 that penetrates through two surfaces of the antenna base 102 is formed at the center and a recess 108 is formed at the front in a top view. The penetration portion 106 is used for insertion of a member for electrically connecting a ground of the antenna element with the roof 12 of the vehicle 10, and is also used for pulling of various cables of the antenna device 100 into the vehicle 10.

A patch antenna 200 is installed in a recess 108. When seen from the accommodation space of the antenna device 100, the patch antenna 200 is accommodated in the front part. Although not illustrated in the drawings, it is possible to accommodate in the central and rear parts of the accommodation space the other antenna elements for different applications, such as an AM/FM antenna, a long term evolution (LTE) antenna, a global navigation satellite system (GNSNS) antenna, and an SXM (Sirius XM) antenna. When these other antenna elements are to be accommodated, the other antenna elements are mounted on the upper surface of the metal base and fixed together with the metal base to the antenna base 102 by screwing or the like. At the time of attaching the antenna device 100 to the roof 12 of the vehicle 10, the metal base is electrically connected to the roof 12, whereby the metal base has the same potential as the roof 12 and functions as a ground.

The patch antenna 200 is an antenna to receive a circularly polarized wave and is made up of a ground plate 202, an amplifier board 204, an antenna main body 210, a parasitic element holder 208, and a parasitic element 220. The ground plate 202 is a sheet-like conductive member to be a ground of the antenna main body 210. The antenna main body 210 is mounted on the upper surface of the amplifier board 204.

The antenna main body 210 includes a dielectric body and a radiating element, and in the same manner as in the conventional patch antenna, the antenna main body 210 can be produced by applying a manufacturing method for a printed board and a printing technique for a ceramic board. The parasitic element 220 is formed of a metal sheet and provided above the antenna main body 210 while keeping a predetermined distance therefrom in order to improve an antenna gain of the antenna main body 210. The parasitic element holder 208 has an annular shape, having a perpendicularly penetrating hole into which the antenna main body 210 can be fitted. In addition, a projection piece projecting upward is provided on the upper surface of the parasitic element holder 208, and by fixing the parasitic element 220 to the projection piece, the predetermined distance is kept between the antenna main body 210 and the parasitic element 220.

Although it is configured in the first embodiment such that the parasitic element 220 is fixed using the parasitic element holder 208, for example, the parasitic element 220 may be fixed to the inside of the antenna case 110 to make the parasitic element holder 208 unnecessary. While the parasitic element 220 is fixed to the inside of the antenna case 110, the parasitic element holder 208 may be used and the parasitic element 220 may be fixed to both the antenna case 110 and the parasitic element holder 208. When the inner case is provided inside the antenna case 110, the parasitic element 220 may be fixed inside the inner case instead of the antenna case 110 to make the parasitic element holder 208 unnecessary. The parasitic element 220 may be fixed to the outside of the inner case to make the parasitic element holder 208 unnecessary.

The ground plate 202 is not electrically connected to the metal base that becomes a ground of another antenna element, but and a potential of the ground plate 202 becomes an electrically independent ground potential. This is for preventing deterioration in electric characteristics due to expansion of the interval between the antenna main body 210 of the patch antenna 200 and the roof 12 at the time of mounting the antenna device 100 onto the roof 12 of the vehicle 10, so that the patch antenna 200 obtains favorable circularly polarized wave characteristics.

Although the antenna base 102 has been the resin base in the first embodiment, the antenna base 102 may be a metal base instead of the resin base. When the antenna base 102 is the metal base, the ground plate 202 may not be provided.

Patch Antenna

While a detail of the patch antenna 200 will be described later, first, a direction with respect to the patch antenna 200 is defined as follows. That is, the patch antenna 200 has a structure in which the radiating element 214 is superimposed on a dielectric body 212, and a direction from the side provided with the radiating element 214, namely, the dielectric body 212 toward the radiating element 214 is referred to as a "radiating direction."

Further, three orthogonal axes of a left-handed system are defined with respect to the patch antenna 200. Namely, the center of the plate surface of the radiating element 214 having a sheet shape is taken as an origin. Then, a direction vertical to the plate surface of the radiating element 214 (a normal direction to the plate surface) is taken as a Z-axis direction, and the radiating direction is taken as a Z-axis positive direction. Further, a direction along a direction of a line segment connecting between the center of the plate surface of the radiating element 214 and a feeding point 216 is taken as an X-axis direction, and a direction from the center of the plate surface of the radiating element 214 toward the feeding point 216 is taken as an X-axis positive direction. By defining the Z-axis and the X-axis, a Y-axis is uniquely defined in the three orthogonal axes of the left-handed system. For facilitating the directions of the three orthogonal axes, reference directions indicating directions parallel to the respective axis directions of the three orthogonal axes are added to each drawing. The above directions are referred to as the reference directions because the correct origin of the three orthogonal axes are the center of the plate surface of the radiating element 214. These are indicated just for reference of the directions.

An XZ-plane including the X-axis and the Z-axis is an E-plane that is an electric field plane of the radiating element 214, and a YZ-plane including the Y-axis and the Z-axis is an H-plane that is a magnetic field plane of the radiating element 214.

In the patch antenna 200, the direction along the Z-axis is the perpendicular direction because the patch antenna 200 is accommodated into the antenna device 100 with its radiating direction upward. Hereinafter, a direction toward the Z-axis positive direction is also referred to as an upward direction, and a direction toward a Z-axis negative direction is also referred to as a downward direction. In addition, a viewpoint for seeing the patch antenna 200 from the Z-axis positive direction toward the Z-axis negative direction is referred to as a planar view.

Figure 3:
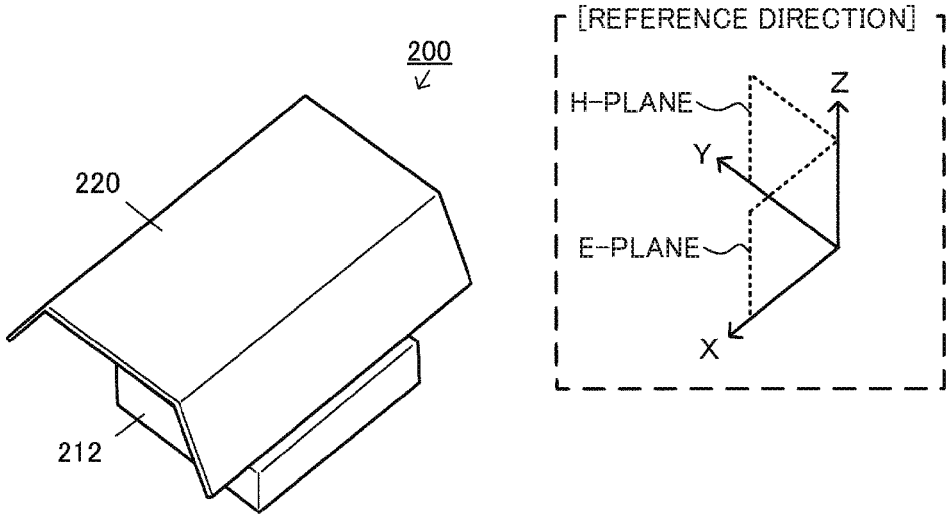
FIG. 3 is a perspective view of a patch antenna in a first embodiment.
Figure 4:
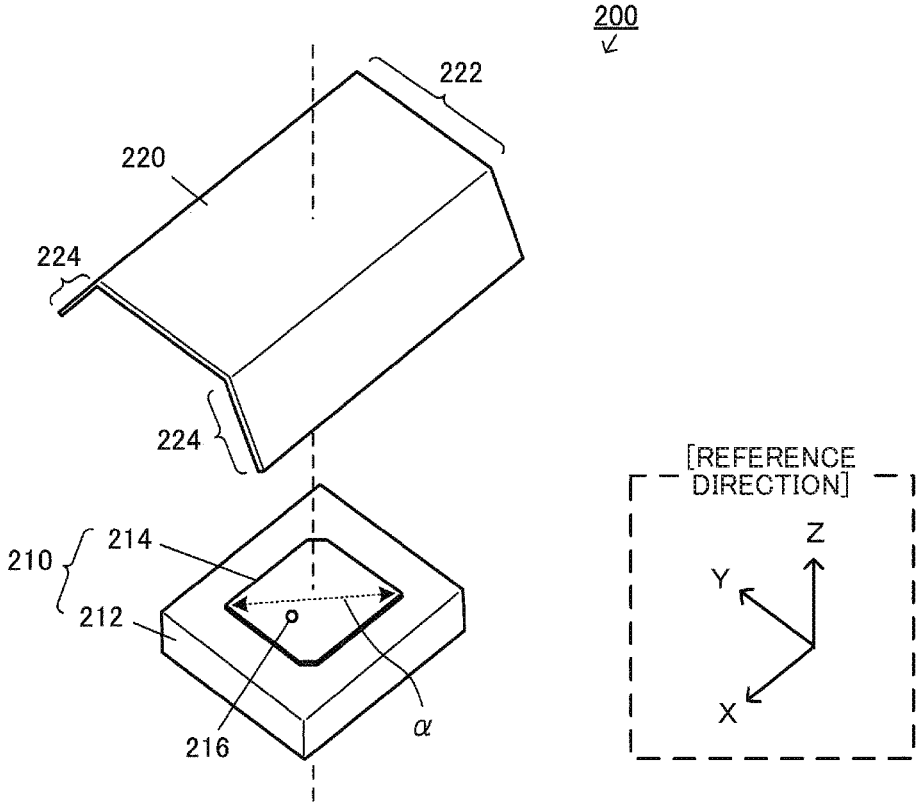
FIG. 4 is a perspective view of the patch antenna in the first embodiment.
Figure 5:
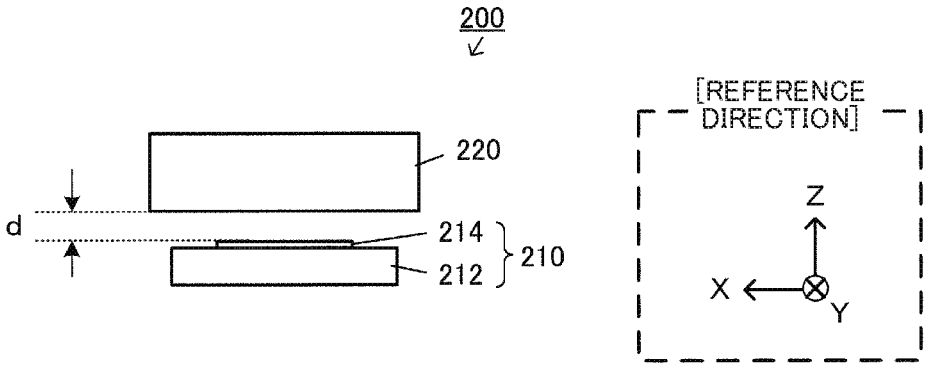
FIG. 5 is a side view of the patch antenna in the first embodiment.
Figure 6:
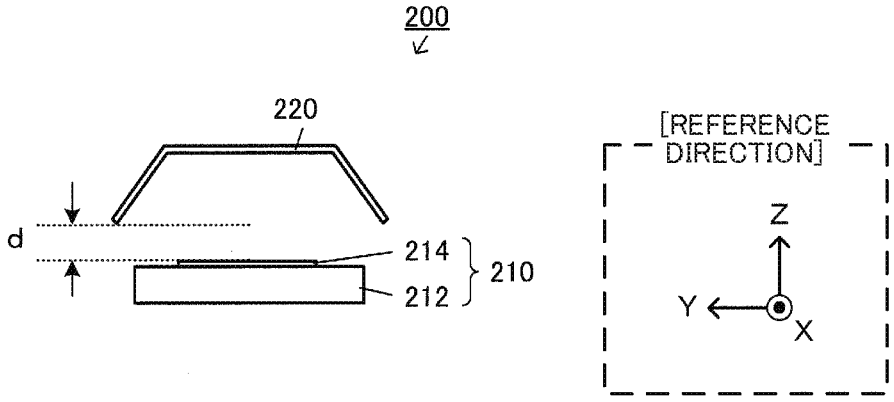
FIG. 6 is a side view of the patch antenna in the first embodiment.

FIGS. 3 to 6 are main configuration views of the patch antenna 200 in the first embodiment. For facilitating understanding of the features of the first embodiment, only the antenna main body 210 and the parasitic element 220, being main members of the patch antenna 200, are illustrated. FIG. 3 is a perspective view of the patch antenna 200. FIG. 4 is a perspective view illustrating the antenna main body 210 and the parasitic element 220 with the interval therebetween enlarged. FIG. 5 is a side view of the patch antenna 200 seen from a Y-axis negative direction toward a Y-axis positive direction. FIG. 6 is a side view of the patch antenna 200 seen from the X-axis positive direction toward an X-axis negative direction.

The antenna main body 210 includes the dielectric body 212 and the radiating element 214 provided on the upper surface of the dielectric body 212. Although the Z-axial thickness of the radiating element 214 is drawn to be large in FIGS. 5 and 6, the actual radiating element 214 is formed in a sheet shape, namely, as a thin film.

The dielectric body 212 is formed in a substantially quadrangular shape in a planar view as seen from the above that is the Z-axis positive direction, and the radiating element 214 is provided on the upper surface being a first surface. The radiating element 214 is formed in a substantially quadrangular shape in the planar view.

In the radiating element 214, a core wire attachment hole 216 being a Z-axial through hole for insertion and fixing of a core wire of a cable is formed at a position offset from the center of the upper surface to the X-axis positive direction. This core wire attachment hole 216 becomes a feeding point. Hence, in the following, the core wire attachment hole 216 is called the feeding point 216 as appropriate. Although not illustrated in the drawings, also in the dielectric body 212 provided on the lower surface of the radiating element 214, a core wire attachment hole penetrating in the Z-axis direction is formed at a position communicating with the core wire attachment hole 216 of the radiating element 214.

The parasitic element 220 is provided in a position apart from the upper surface of the radiating element 214 to the Z-axis positive direction. The dielectric body 212 is provided with its first surface, provided with the radiating element 214, facing the parasitic element 220. The separation between the radiating element 214 and the parasitic element is realized by the parasitic element holder 208 (cf. FIG. 2).

The parasitic element 220 is a three-dimensionally shaped metal member formed by bending a substantially quadrangular metal sheet. Specifically, the parasitic element 220 is shaped by bending both Y-axial ends of the metal sheet to the Z-axis negative direction, and the parasitic element 220 includes a planar portion 222 being a sheet parallel to the upper surface of the radiating element 214, and bent portions 224 that are inclined portions inclined from both Y-axial ends of the planar portion 222 toward the Z-axis negative direction.

While in a three-dimensional shape as a whole, the parasitic element 220 has such features as follow: The parasitic element 220 has a planar-view area wider than that of the radiating element 214 in a planar view that is a viewpoint of the patch antenna 200 as seen from the Z-axis positive direction being the first surface side of the dielectric body 212, and the parasitic element 220 is provided in a position to cover the radiating element 214 in the planar view, while being located apart from the radiating element 214. Further, the entire shape of the parasitic element 220 is a convex shape toward the Z-axis positive direction that is the viewpoint of the planar view. It can also be said that the parasitic element 220 forms the convex shape by having the bent shape that includes the bent portions 224 being a plurality of inclined portions. In the example of the parasitic element 220 in the first embodiment, the number of the bent portions 224 being the inclined portions is two. It can also be said that the parasitic element 220 forms the convex shape by having the bent shape formed by performing bending on a metal sheet a predetermined number of times. In the example of the parasitic element 220 in the first embodiment, the predetermined number of times is two. The number of the bent portions 224 being the inclined portions may be one.

Although a detail will be described later, a distance d between the radiating element 214 and the parasitic element 220 is set to equal to or smaller than twice the maximum outer dimension $\alpha$ of the radiating element 214 in the planar view, and more preferably set to equal to or greater than 0.18 times and equal to or smaller than 0.59 times the maximum outer dimension $\alpha$. The maximum outer dimension $\alpha$ is a length being the maximum of the outer dimension of the radiating element 214. Since the radiating element 214 is a substantially quadrangular shape, the maximum outer dimension $\alpha$ of the radiating element 214 in the planar view is a length of a diagonal line of the radiating element 214 as illustrated in FIG. 4.

The distance d between the radiating element 214 and the parasitic element 220 is defined as follows: as illustrated in FIGS. 5 and 6, in a direction vertical to the upper surface of the radiating element 214 (Z-axis direction), a plane including the upper surface of the radiating element 214 (i.e., a plane parallel to the XY-plane) is taken as a reference plane at a distance zero, and the distance d is the shortest distance from the reference plane to the parasitic element 220. Since the parasitic element 220 has the shape formed by bending both Y-axial ends downward, the shortest distance from the reference plane including the upper surface of the radiating element 214 to the both ends is the distance d between the radiating element 214 and the parasitic element 220.

Figure 7:
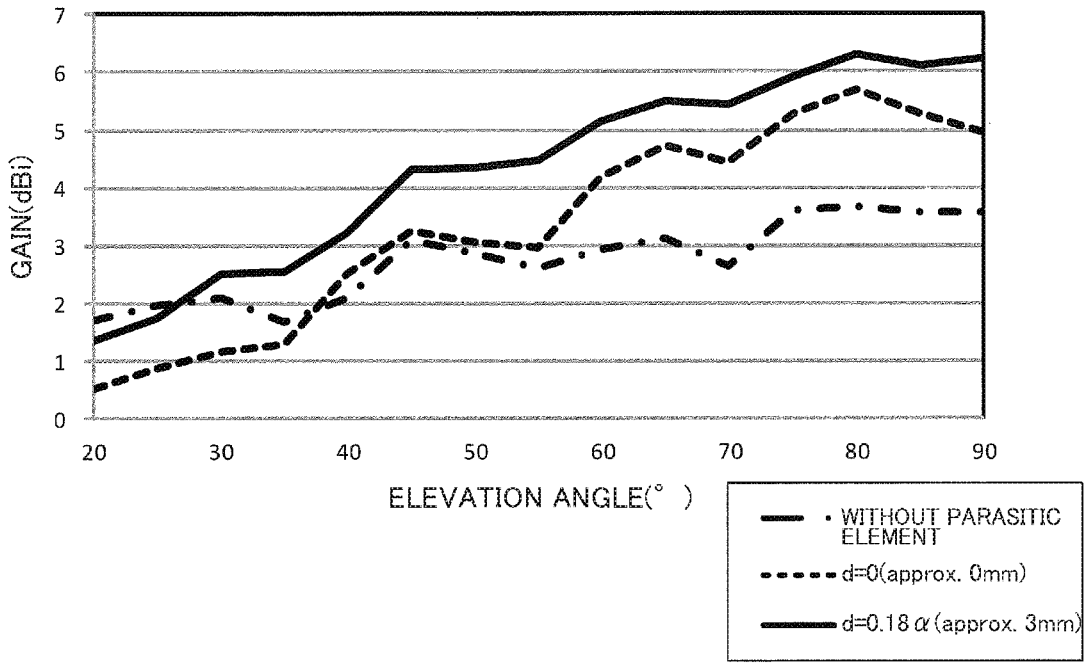
FIG. 7 is a gain characteristic graph of patch antennas different in distance between a radiating element and a parasitic element.
Figure 8:
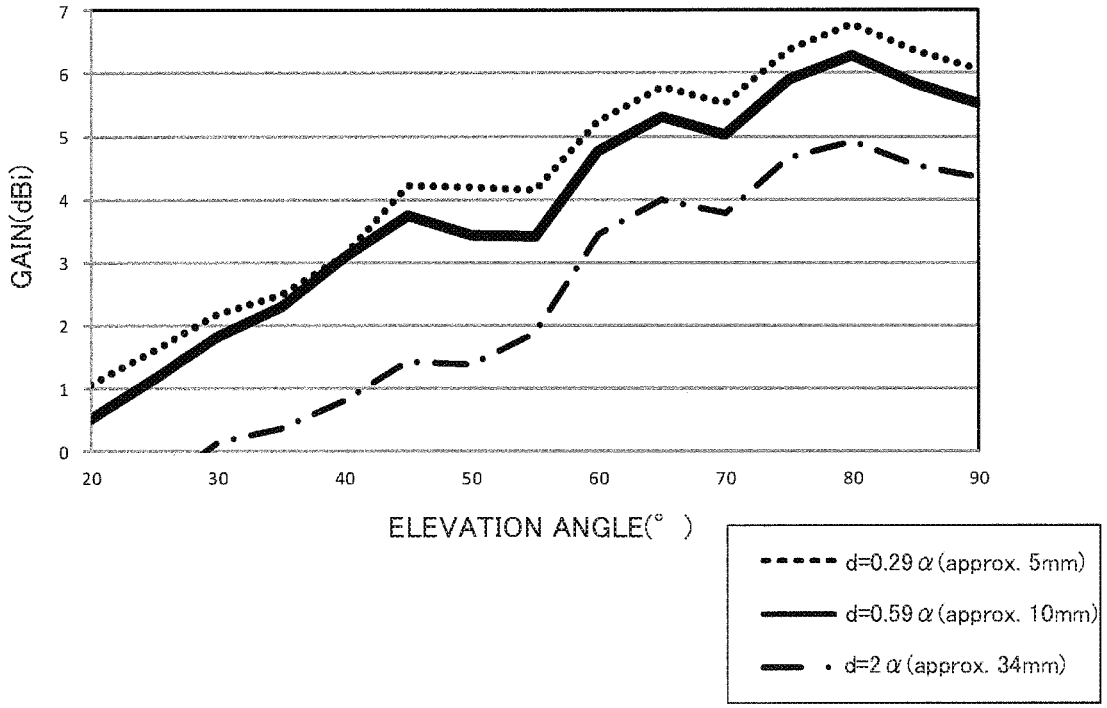
FIG. 8 is a gain characteristic graph of patch antennas different in distance between the radiating element and the parasitic element.

FIGS. 7 and 8 are graphs indicating test results of gain characteristics in the case of making different the distance d between the radiating element 214 and the parasitic element 220 in the patch antenna 200. FIGS. 7 and 8 both indicate an average gain on the horizontal plane at the time of receiving a circularly polarized wave, with the XY-plane direction taken as an elevation angle of 0 degree and the Z-axis positive direction that is the radiating direction taken as an elevation angle of 90 degrees, as seen from the origin of the patch antenna 200. In FIG. 7, in addition to an antenna gain in the case of setting the distance d between the radiating element 214 and the parasitic element 220 to "0" and "0.18α (about 3 mm), an antenna gain in the case of omitting the parasitic element 220 is also indicated as a comparative example. A dotted line indicates the case of the distance d being "0", a solid line indicates the case of the distance d being "0.18α", and a dashed-dotted line indicates the case of the comparative example in which the parasitic element is omitted. FIG. 8 indicates antenna gains in the case of setting the distance d between the radiating element 214 and the parasitic element 220 to "0.29α (about 5 mm)", "0.59α (about 10 mm)", and "2α (about 34 mm)". A dotted line indicates the case of the distance d being "0.29α", a solid line indicates the case of the distance d being "0.59α", and a dashed-dotted line indicates the case of the distance d being "2α". In this test, the maximum outer dimension α of the parasitic element 220 is "17 mm."

As illustrated in FIGS. 7 and 8, when attention is focused on a high elevation angle range of 60 to 90 degrees, it is found that by providing the parasitic element 220, the antenna gain has been improved as compared with the case of omitting (not providing) the parasitic element 220. It is also found that the antenna gain varies when the distance d between the radiating element 214 and the parasitic element 220 varies.

Figure 9:
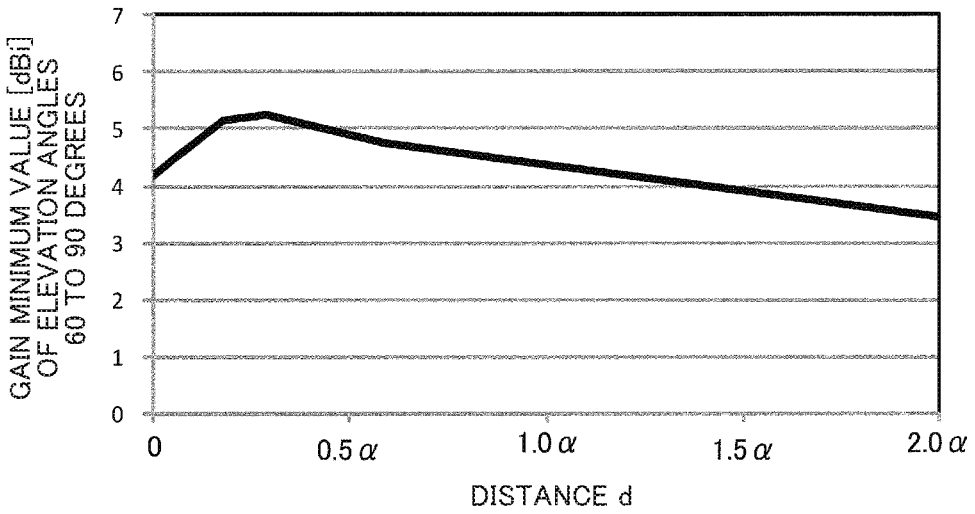
FIG. 9 is a graph of the minimum gain with respect to the distance between the radiating element and the parasitic element.

FIG. 9 is a graph obtained from the test results of FIGS. 7 and 8, indicating the minimum value of the antenna gain in the high elevation angle range of 60 to 90 degrees with respect to the distance d between the radiating element 214 and the parasitic element 220. The minimum value of the antenna gain in the high elevation angle range in the case of omitting the parasitic element 220 is 2.9 [dBi]. According to FIG. 9, when the distance d is equal to or smaller than "2α", it is possible to obtain an antenna gain higher than 2.9 [dBi] that is the antenna gain in the case of omitting the parasitic element 220. Hence, it is desirable to set the distance d between the radiating element 214 and the parasitic element 220 to be equal to or smaller than twice the maximum outer dimension α of the radiating element 214. Further, it is more preferable to set the distance d to be in a range from "0.18α" to "0.59α" that is in the vicinity of a peak value of the antenna gain in the case of changing the distance d. The antenna gain obtained at this time is approximately 5 [dBi].

Figure 10:
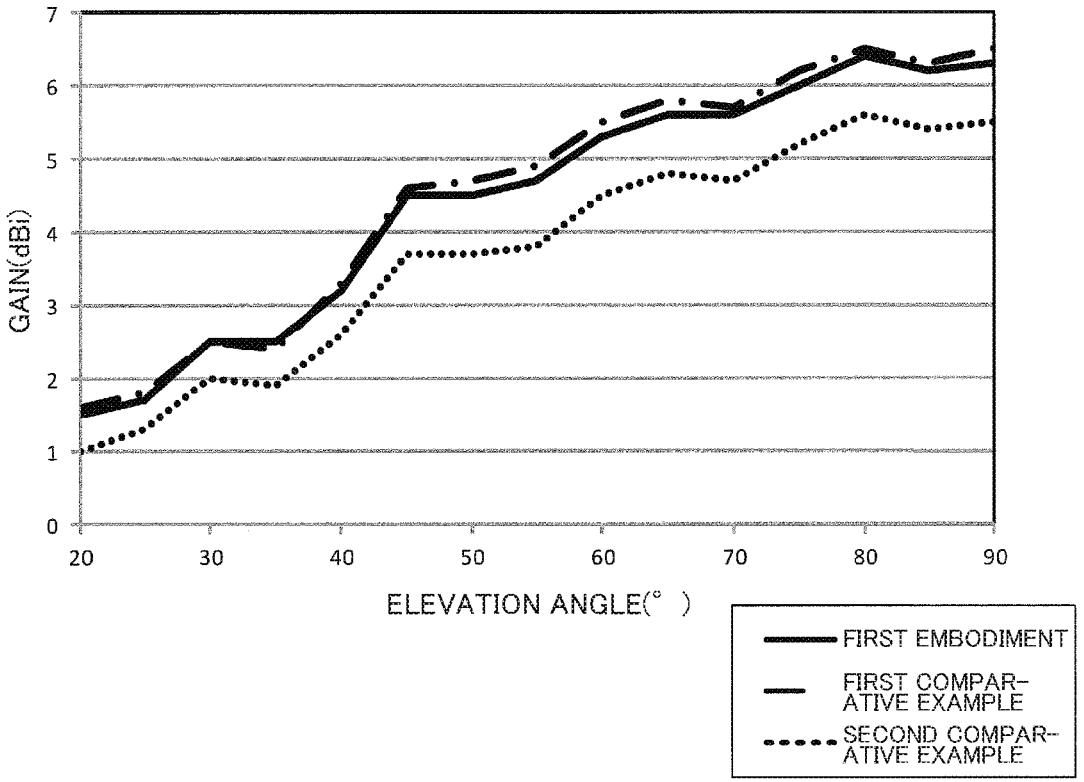
FIG. 10 is a gain characteristic graph of the patch antenna in the first embodiment.

Subsequently, the effects of the patch antenna 200 in the first embodiment will be described. FIG. 10 indicates a horizontal plane average gain obtained when the patch antenna 200 received a circularly polarized wave of 2332.5 [MHz]. As for the elevation angle being the horizontal axis, the direction of the XY-plane as seen from the origin of the patch antenna 200 is taken as 0 degree, and the Z-axis positive direction is taken as 90 degrees. Further, as comparative examples, antenna gains of two types of patch antennas, in each of which the configuration of the parasitic element 220 is made different from that in the first embodiment, are also indicated as a first comparative example and a second comparative example. A solid line indicates the first embodiment, a dashed-dotted line indicates the first comparative example, and a dotted line indicates the second comparative example.

Figure 11:
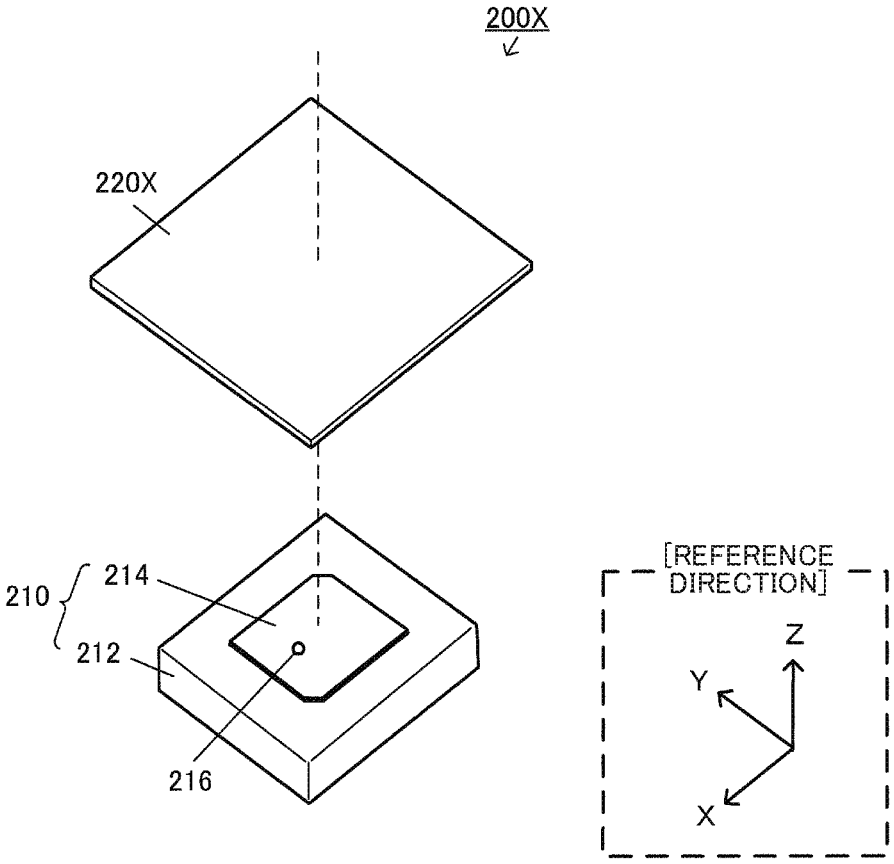
FIG. 11 is a perspective view of a patch antenna in a first comparative example.

FIG. 11 is a perspective view indicating a configuration of a patch antenna 200X in the first comparative example. FIG. 11 illustrates the antenna main body 210 and a parasitic element 220X with the interval therebetween enlarged. The difference between the patch antenna 200X in the first comparative example and the patch antenna 200 in the first embodiment is the parasitic element 220X. The antenna main body 210 has a similar configuration to that of the antenna main body 210 (cf. FIG. 4) in the first embodiment. The parasitic element 220X is a plate-like and substantially quadrangular shape metal sheet obtained when no bent shape is formed in the parasitic element 220 in the first embodiment. The parasitic element 220X has a shape formed by flatly developing the planar portion 222 of the parasitic element 220 and the two bent portions 224 in FIG. 4. A total of the upper surface areas of the planar portion 222 and the two bent portions 224 is the upper surface area of the parasitic element 220X, and the surface areas of the parasitic element 220 and the parasitic element 220X are the same. In other words, the patch antenna 200X in the first comparative example corresponds to the conventional patch antenna.

Figure 12:
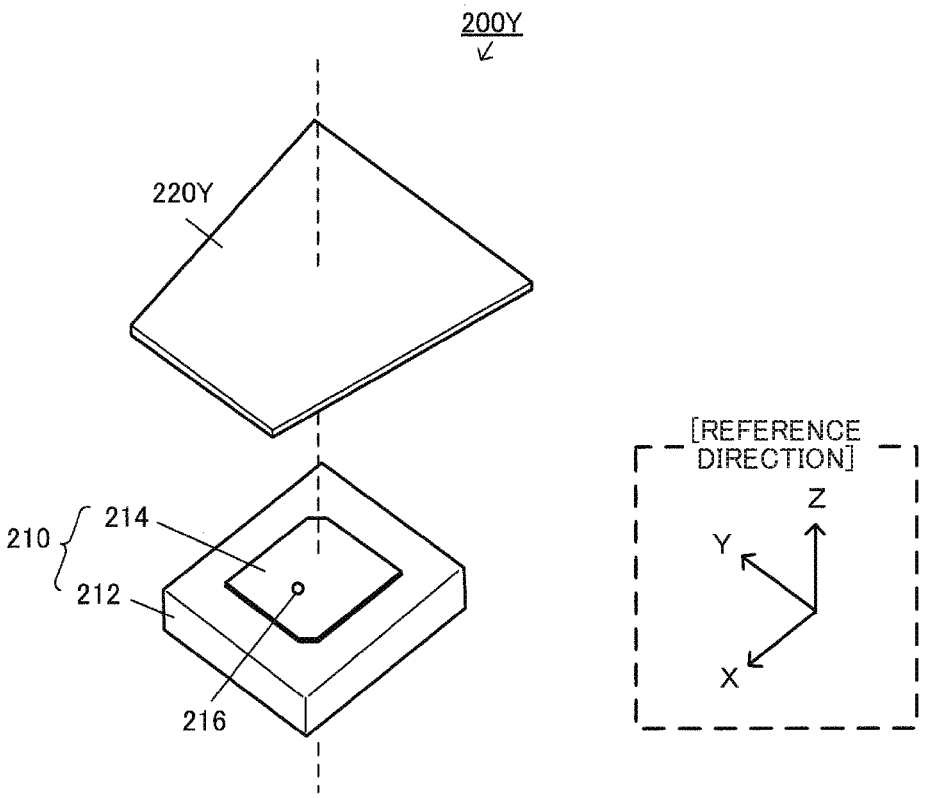
FIG. 12 is a perspective view of a patch antenna in a second comparative example.

FIG. 12 is a perspective view illustrating a configuration of a patch antenna 200Y in the second comparative example. FIG. 12 illustrates the antenna main body 210 and a parasitic element 220Y with the interval therebetween enlarged. The difference between the patch antenna 200Y in the second comparative example and the patch antenna 200 in the first embodiment is the parasitic element 220Y. The antenna main body 210 has a similar configuration to that of the antenna main body 210 (cf. FIG. 4) in the first embodiment. The parasitic element 220Y is a trapezoidal metal sheet in the planar view. The upper surface area of the parasitic element 220Y is smaller than that of the parasitic element 220X in the first comparative example and is the same as the area of the planar portion 222 of the parasitic element 220 in the first embodiment. With the patch antenna 200Y being disposed in the front of the accommodation space inside the antenna device 100 forming the shark fin shape, the parasitic element 220Y is formed such that its Y-axial length being a horizontal width decreases toward the X-axis positive direction that is the front.

According to FIG. 10, in comparison between the patch antenna 200 in the first embodiment and the patch antenna 200X in the first comparative example, it is found that the antenna gain characteristics are almost the same. Further, in comparison between the patch antenna 200 in the first embodiment and the patch antenna 200Y in the second comparative example, it is found that the antenna gain in the first embodiment is higher at all the elevation angles. Thus, even when the parasitic element 220 is formed in the three-dimensional shape being the convex shape toward the Z-axis positive direction that is the viewpoint of the planar view as in the patch antenna 200 in the first embodiment, it is possible to obtain an antenna gain equivalent to an antenna gain obtained when a plate-like parasitic element corresponding to the related art is used.

According to the first embodiment, the antenna gain of the parasitic element 220 does not deteriorate as long as the parasitic element 220 has a planar-view area wider than that of the radiating element 214 in the planar view and is provided in a position to cover the radiating element 214 in the planar view. Therefore, the design flexibility of the profile shape of the entire patch antenna 200 improves. For example, as illustrated in FIG. 2, the patch antenna 200 in the first embodiment is accommodated in the front of the inner accommodation space of the antenna device 100. Further, the antenna device 100 in the first embodiment has the shark fin shape as a whole, and the antenna case 110 has a shape with its horizontal width decreases toward the above. Although this limits the upper space at the time of accommodating the patch antenna 200, according to the first embodiment, the parasitic element 220 can be formed in a three-dimensional shape, so that the profile shape of the entire patch antenna 200 can be designed in accordance with the shape of the accommodation space.

Modified Example

In the first embodiment, the parasitic element 220 has been configured as the three-dimensional shape forming the convex shape toward the viewpoint of the planar view, but as a variation of the convex shape, the parasitic element 220 may be configured as follows in accordance with the inner wall of the inner case that defines the accommodation space.

Figure 13:
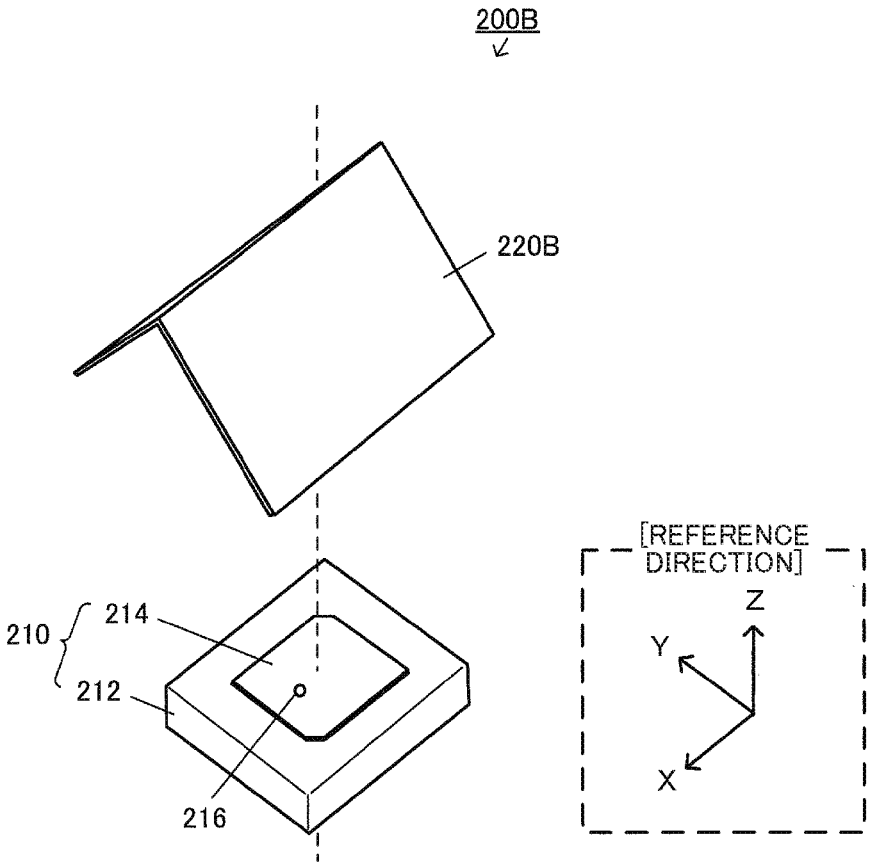
FIG. 13 is a view illustrating a first modified example of the patch antenna in the first embodiment.

FIG. 13 is a view illustrating a first modified example and is a perspective view illustrating a configuration example of a patch antenna 200B with the parasitic element formed in an inverted V-shape. FIG. 13 illustrates the antenna main body 210 and a parasitic element 220B with the interval therebetween enlarged. In the first embodiment, the parasitic element 220 has formed the convex shape by having, besides the planar portion 222, the bent shape that includes two bent portions 224 being the inclined portions. In the first modified example, the convex shape is formed by forming a bent shape of two bent portions 224 being the inclined portions in the first embodiment, without the planar portion 222. In other words, in the first embodiment, the parasitic element 220 has formed the convex shape by having the bent shape formed by performing bending on the metal sheet twice. In the first modified example, the convex shape is formed by having the bent shape formed by performing bending on the metal sheet once. The difference between the patch antenna 200B in the first modified example and the patch antenna 200 in the first embodiment is the parasitic element 220B. The antenna main body 210 has a similar configuration to that of the antenna main body 210 (cf. FIG. 4) in the first embodiment. The parasitic element 220B has a three-dimensional shape forming a convex shape toward the viewpoint of the planar view, has an inverted V-shape as a whole, and is disposed such that its ridge line is parallel to the X-axis direction. The parasitic element 220B is the same as the parasitic element 220 in having a planar-view area wider than that of the radiating element 214 in the planar view and being provided in a position to cover the radiating element 214 in the planar view. The parasitic element 220B in the first modified example can be formed by, for example, bending a substantially quadrangular metal sheet along a central line that is along the X-axis direction. This can reduce the labor in manufacturing of the parasitic element 220B as compared with the parasitic element 220 in the first embodiment.

Figure 14:
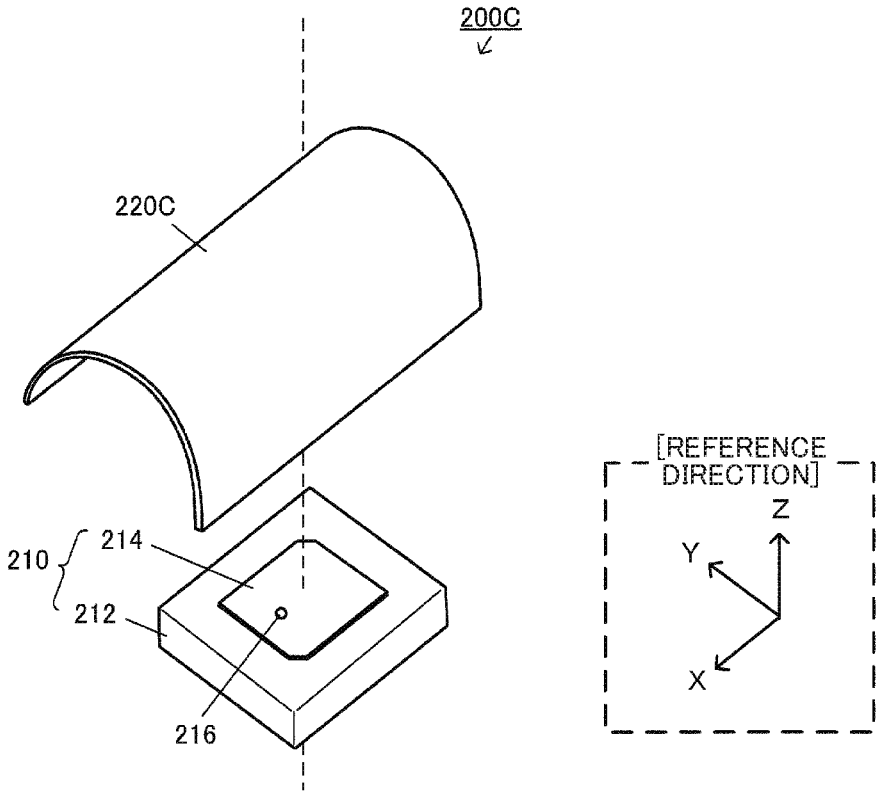
FIG. 14 is a view illustrating a second modified example of the patch antenna in the first embodiment.

FIG. 14 is a view illustrating a second modified example and is a perspective view illustrating a configuration example of a patch antenna 200C with the parasitic element formed in an arch shape. FIG. 14 illustrates the antenna main body 210 and a parasitic element 220C with the interval therebetween enlarged. The difference between the patch antenna 200C in the second modified example and the patch antenna 200 in the first embodiment is the parasitic element 2200. The antenna main body 210 has a similar configuration to that of the antenna main body 210 (cf. FIG. 4) in the first embodiment. The parasitic element 220C has an arch shape that is a three-dimensional shape forming a convex shape toward the viewpoint of the planar view, and is a curved portion of a half cylinder disposed such that its longitudinal direction is parallel to the X-axis direction. The half cylinder includes not only one obtained by cutting an exact circle into halves but also one obtained by cutting an ellipse into halves in cross section. The half cylinder also includes one obtained in the case of partially cutting the exact circle or the ellipse instead of cutting them into halves in cross section. The parasitic element 220C is the same as the parasitic element 220 in having a planar-view area wider than that of the radiating element 214 in the planar view and being provided in a position to cover the radiating element 214 in the planar view. The parasitic element 220C in the second modified example can be formed by, for example, bending a substantially quadrangular metal sheet so as to form a curved surface projecting to the X-axis positive direction.

Figure 15:
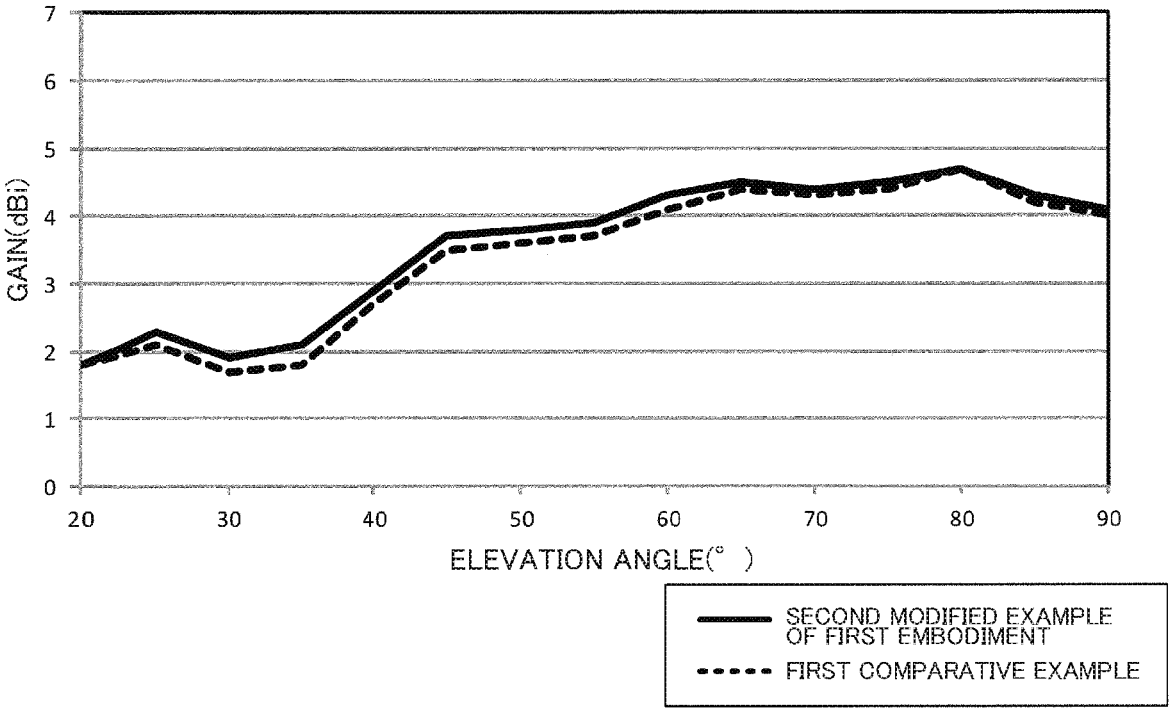
FIG. 15 is a gain characteristic graph of the patch antenna in the second modified example.

FIG. 15 indicates a horizontal plane average gain when the patch antenna 200C of the second modified example received a circularly polarized wave of 2332.5 [MHz]. As for the elevation angle being the horizontal axis, the direction of the XY-plane as seen from the origin of the patch antenna 200C (the center of the upper surface of the radiating element 214) is taken as 0 degree, and the Z-axis positive direction is taken as 90 degrees. Further, as a comparative example, the antenna gain of the patch antenna 200X (cf. FIG. 11) in the first comparative example described above is also indicated. A solid line indicates the antenna gain in the second modified example, and a dotted line indicates the antenna gain in the first comparative example. In addition, in this test, the planar-view area of the parasitic element 220C in the second modified example was assumed to be the same as that of the parasitic element 220X in the first comparative example. The parasitic element 220C is configured such that, when the parasitic element 220C is flatly developed, its surface area becomes greater than that of the parasitic element 220X.

In comparison between the patch antenna 200C in the second modified example and the patch antenna 200X in the first comparative example, the antenna gains were almost the same at some elevation angles, but at almost all the elevation angles, the antenna gain of the patch antenna 200C in the second modified example was higher than that of the patch antenna 200X in the first comparative example.

Second Embodiment

Next, a second embodiment will be described. The second embodiment is an embodiment obtained by changing the parasitic element 220 of the patch antenna 200 in the second embodiment. In the following, a similar configuration to that in the first embodiment described above will be provided with the same numeral, and a detailed description thereof will be omitted or simplified.

Patch Antenna

Figure 16:
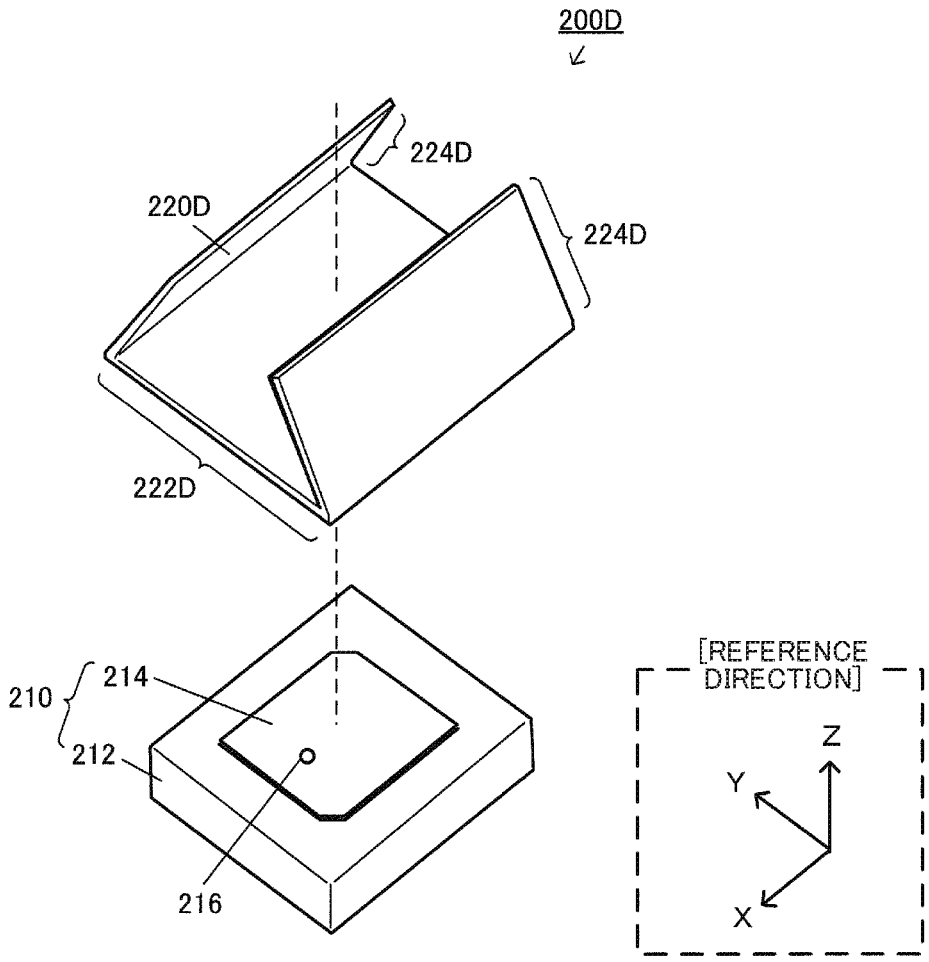
FIG. 16 is a perspective view of a patch antenna in a second embodiment.
Figure 17:
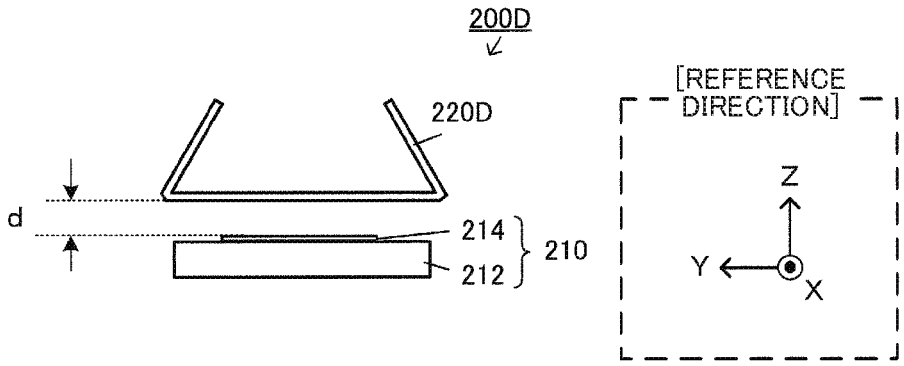
FIG. 17 is a side view of the patch antenna in the second embodiment.

FIGS. 16, 17 are main configuration views of a patch antenna 200D in the second embodiment. FIG. 16 is a perspective view of the patch antenna 200D. FIG. 16 illustrates the antenna main body 210 and a parasitic element 220D with the interval therebetween enlarged. FIG. 17 is a side view of the patch antenna 200D seen from the X-axis positive direction toward the X-axis negative direction.

The parasitic element 220D is a three-dimensionally shaped metal member formed by bending a substantially quadrangular metal sheet. Specifically, the parasitic element 220D is formed by bending both Y-axial ends of the metal sheet upward (to the Z-axis positive direction), and the parasitic element 220D includes a planar portion 222D being a central part which is parallel to the radiating element 214, and bent portions 224D which are bent upward from both Y-axial ends of the planar portion 222D. The parasitic element 220D forms as the entire shape a convex shape toward the Z-axis positive direction being the viewpoint of the planar view. While in a three-dimensional shape as a whole, the parasitic element 220D has a planar-view area wider than that of the radiating element 214 in a planar view that is a viewpoint of the patch antenna 200D as seen from the Z-axis positive direction being the first surface side of the dielectric body 212, and the parasitic element 220D is provided in a position apart from the radiating element 214 and to cover the radiating element 214 in the planar view.

In the same manner as in the first embodiment, the distance d between the radiating element 214 and the parasitic element 220D is defined as follows: As illustrated in FIG. 17, in a direction vertical to the upper surface of the radiating element 214 (i.e., a direction along the Z-axis positive direction), a plane including the upper surface of the radiating element 214 (i.e., a plane parallel to the XY-plane) is taken as a reference plane at a distance zero, and the shortest distance from the reference plane to the parasitic element 220D is assumed to be the distance d. Since the parasitic element 220D has a shape formed by bending both Y-axial ends upward, the distance from the reference plane to the lower surface of the planar portion 222D is the distance d between the radiating element 214 and the parasitic element 220D. Similarly to the first embodiment, the distance d is set to equal to or smaller than twice the maximum outer dimension $\alpha$ of the radiating element 214 in the planar view, and more preferably set to equal to or greater than 0.18 times and equal to or smaller than 0.59 times the maximum outer dimension $\alpha$.

Test Results

Figure 18:
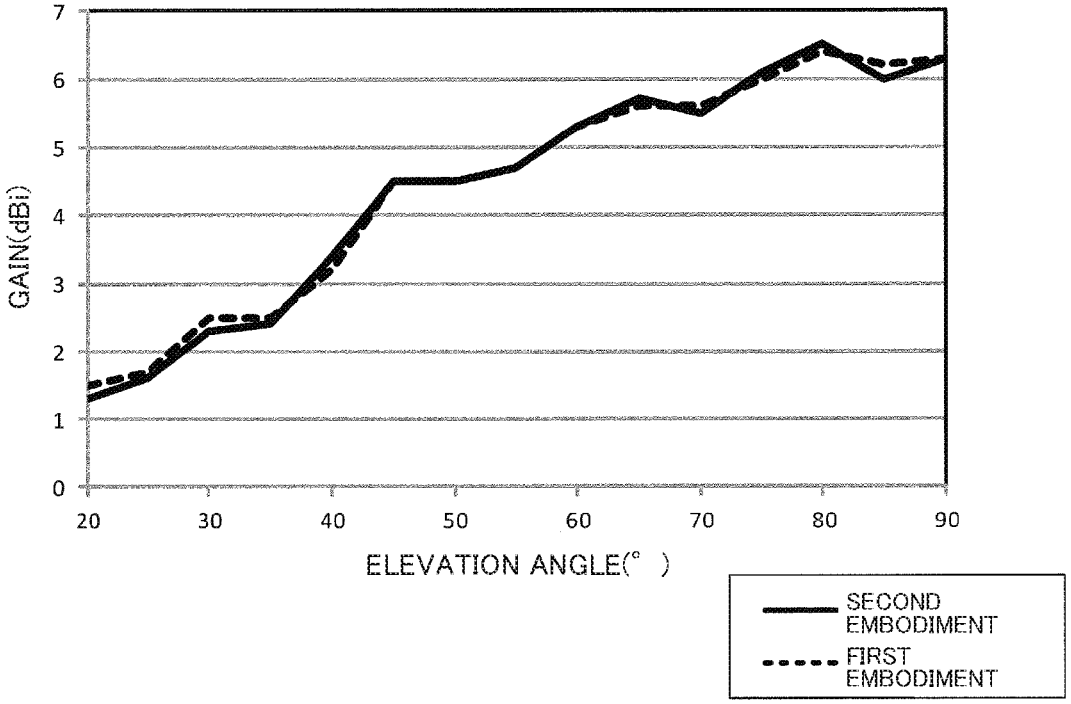
FIG. 18 is a gain characteristic graph of the patch antenna in the second embodiment.

Subsequently, the effects of the patch antenna 200D in the second embodiment will be described. FIG. 18 indicates a horizontal plane average gain obtained when the patch antenna 200D received a circularly polarized wave of 2332.5 [MHz]. As for the elevation angle being the horizontal axis, the direction of the XY-plane as seen from the origin of the patch antenna 200D is taken as 0 degree, and the Z-axis positive direction is taken as 90 degrees. Further, as a comparative example, the antenna gain of the patch antenna 200 in the first embodiment described above is also indicated. A solid line indicates the antenna gain in the second embodiment, and a dotted line indicates the antenna gain in the first embodiment.

In conducting this test, the surface area of the parasitic element 220D was assumed to be the same as that of the parasitic element 220 in the first embodiment. Accordingly, the planar-view area obtained in the case of flatly developing the bent portions 224D of the parasitic element 220D was assumed to be the same as the planar-view area obtained in the case of flatly developing the parasitic element 220 in the first embodiment.

According to FIG. 18, in comparison between the patch antenna 200D in the second embodiment and the patch antenna 200 in the first embodiment, it is found that the antenna gain characteristics are almost the same. Thus, even when the parasitic element 220D is formed in the three-dimensional shape with both ends of the metal sheet bent upward as in the patch antenna 200D in the second embodiment, it is possible to form a configuration having equivalent performance to that of the patch antenna 200 in the first embodiment. The patch antenna 200 in the first embodiment has had the antenna gain equivalent to that in the first comparative example in which the plate-like metal sheet before being bent is used as the parasitic element 220X, corresponding to the related art. It can thus be said that the patch antenna 200D in the second embodiment also has an antenna gain equivalent to that in the first comparative example. Hence, the design flexibility of the profile shape of the entire patch antenna can be improved without deterioration in antenna gain.

Third Embodiment

Next, a third embodiment will be described. The third embodiment is an embodiment obtained by changing the parasitic element 220 of the patch antenna 200 in the first embodiment. In the following, a similar configuration to those in the first embodiment and second embodiment described above will be provided with the same numeral, and a detailed description thereof will be omitted or simplified.

Patch Antenna

Figure 19:
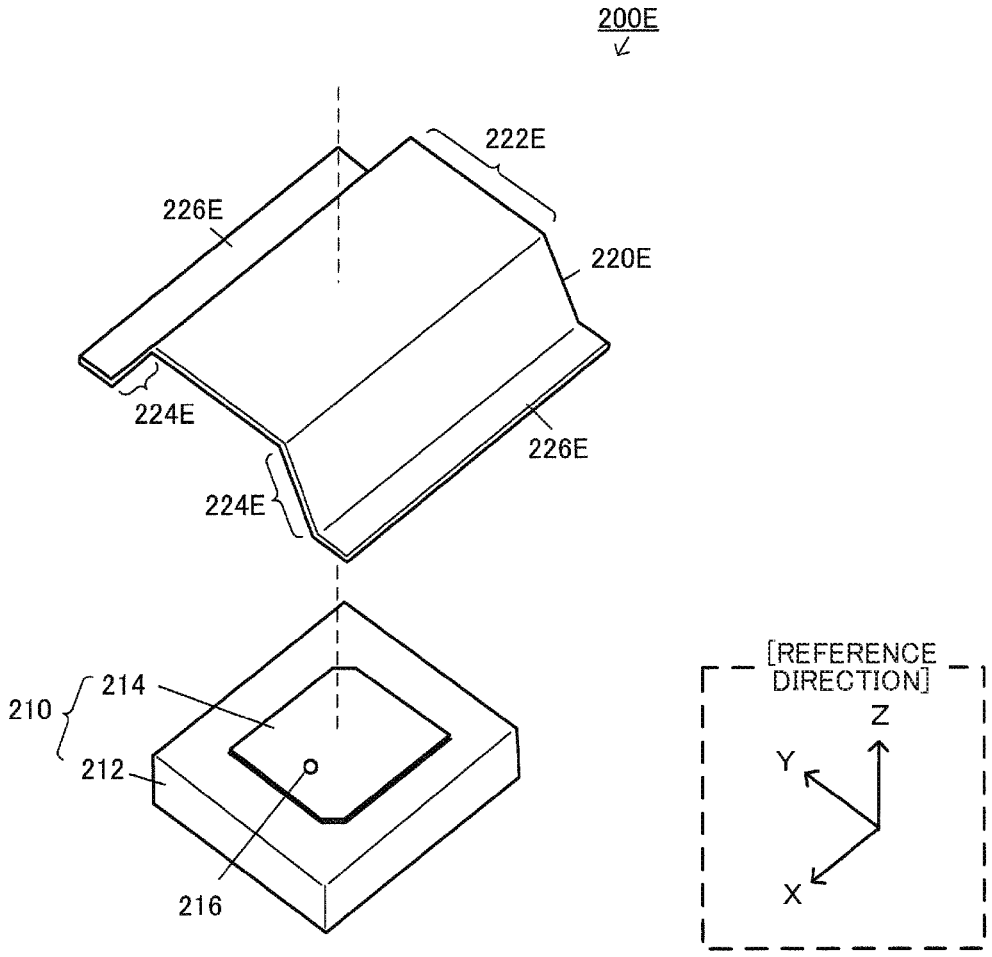
FIG. 19 is a perspective view of a patch antenna in a third embodiment.
Figure 20:
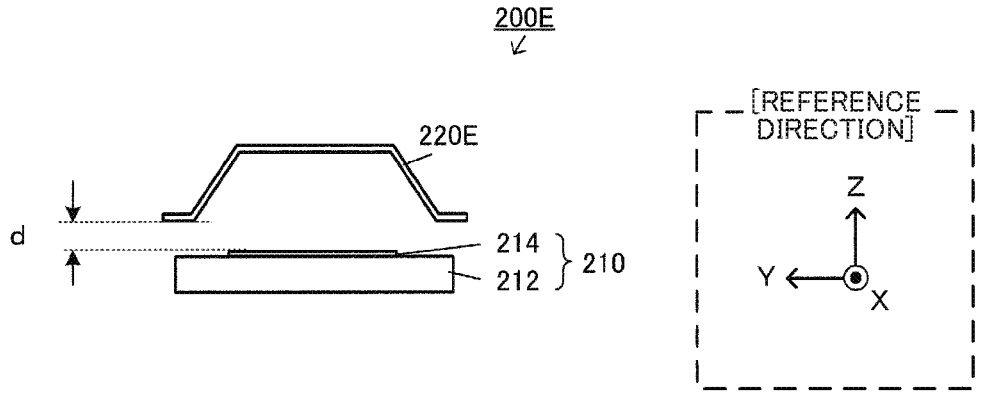
FIG. 20 is a side view of the patch antenna in the third embodiment.

FIGS. 19 and 20 are main configuration views of a patch antenna 200E in the third embodiment. FIG. 19 is a perspective view of the patch antenna 200E. FIG. 19 illustrates the antenna main body 210 and a parasitic element 220E with the interval therebetween enlarged. FIG. 20 is a side view of the patch antenna 200E seen from the X-axis positive direction toward the X-axis negative direction.

The parasitic element 220E is a three-dimensionally shaped metal member formed by bending a substantially quadrangular metal sheet. Specifically, the parasitic element 220E is formed by bending both Y-axial ends of the metal sheet downward (to the Z-axis negative direction) and then performing further bending so as to form the ends of the bent portions 224 into flanges. The parasitic element 220E includes a planar portion 222E being a central part parallel to the plate surface of the radiating element 214, bent portions 224E being inclined portions bent downward from both Y-axial ends of the planar portion 222E, and a flange portions 226E provided continuous to the ends of the bent portions 224E and parallel to the planar portion 222E.

The parasitic element 220E forms as the entire shape a convex shape toward the Z-axis positive direction being the viewpoint of the planar view. While in a three-dimensional shape as a whole, the parasitic element 220E has a planar-view area wider than that of the radiating element 214 in a planar view that is a viewpoint of the patch antenna 200E as seen from the Z-axis positive direction being the first surface side of the dielectric body 212, and the parasitic element 220E is provided in a position apart from the radiating element 214 and to cover the radiating element 214 in the planar view.

In the same manner as in the first embodiment, the distance d between the radiating element 214 and the parasitic element 220E is defined as follows: As illustrated in FIG. 20, in a direction vertical to the upper surface of the radiating element 214 (i.e., a direction along the Z-axis positive direction), a plane including the upper surface of the radiating element 214 (i.e., a plane parallel to the XY-plane) is taken as a reference plane at a distance zero, and the shortest distance from the reference plane to the parasitic element 220E is assumed to be the distance d. Since the parasitic element 220E has the shape formed by bending both Y-axial ends downward and then providing the flange portions 226E parallel to the planar portion 222E, the shortest distance from the reference plane to the flange portion 226E is the distance d between the radiating element 214 and the parasitic element 220E. Similarly to the first embodiment, the distance d is set to equal to or smaller than twice the maximum outer dimension $\alpha$ of the radiating element 214 in the planar view, and more preferably set to equal to or greater than 0.18 times and equal to or smaller than 0.59 times the maximum outer dimension $\alpha$.

Test Results

Figure 21:
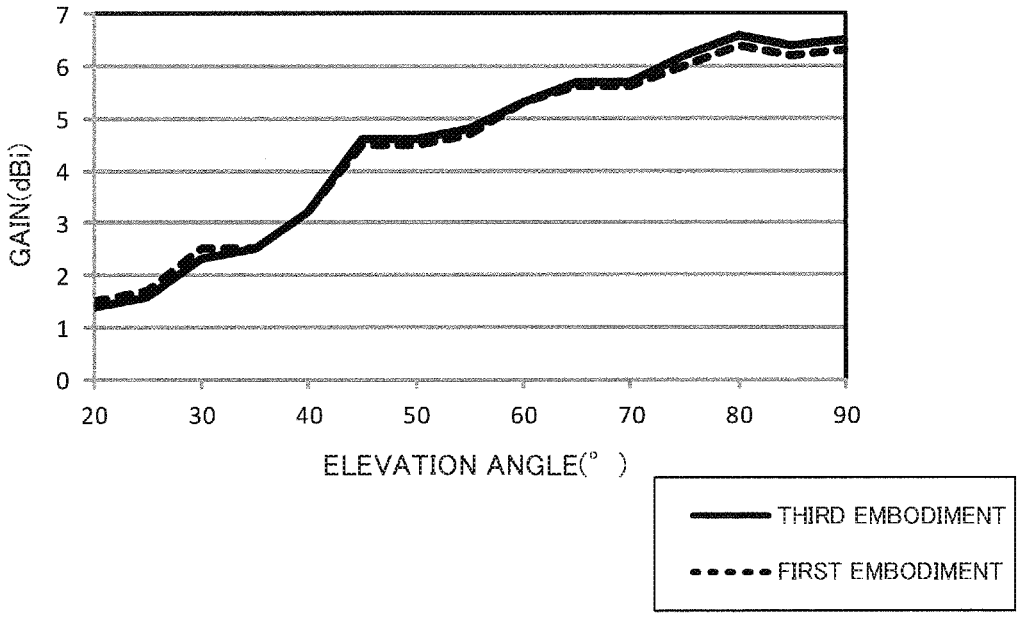
FIG. 21 is a gain characteristic graph of the patch antenna in the third embodiment.

Subsequently, the effects of the patch antenna 200E in the third embodiment will be described. FIG. 21 indicates a horizontal plane average gain obtained when the patch antenna 200E received a circularly polarized wave of 2332.5 [MHz]. As for the elevation angle being the horizontal axis, the direction of the XY-plane as seen from the origin of the patch antenna 200E is taken as 0 degree, and the Z-axis positive direction is taken as 90 degrees. Further, as a comparative example, the antenna gain of the patch antenna 200 in the first embodiment described above is also indicated. A solid line indicates the antenna gain in the third embodiment, and a dotted line indicates the antenna gain in the first embodiment.

In conducting this test, the surface area of the parasitic element 220D was assumed to be the same as that of the parasitic element 220 in the first embodiment. Accordingly, the planar-view area obtained in the case of flatly developing the bent portions 224E and the flange portions 226E of the parasitic element 220E on the same plane as the planar portion 222E was assumed to be the same as the planar-view area obtained in the case of flatly developing the parasitic element 220 in the first embodiment.

According to FIG. 21, in comparison between the patch antenna 200E in the third embodiment and the patch antenna 200 in the first embodiment, it is found that the antenna gain characteristics are almost the same. Thus, even when the parasitic element 220E is formed in the three-dimensional shape with both ends of the metal sheet bent downward and the flange portions further formed as in the patch antenna 200E in the third embodiment, it is possible to form a configuration having equivalent performance to that of the patch antenna 200 in the first embodiment. The patch antenna 200 in the first embodiment has had the antenna gain equivalent to that in the first comparative example in which the plate-like metal sheet before being bent is used as the parasitic element 220X, corresponding to the related art. It can thus be said that the patch antenna 200E in the third embodiment also has an antenna gain equivalent to that in the first comparative example. Hence, the design flexibility of the profile shape of the entire patch antenna can be improved without deterioration in antenna gain.

In addition, providing the flange portions 226E also produces an effect of facilitating attachment work of the parasitic element 220E. For example, slits or hook portions where the flange portions 226E are to be slid and fitted may be provided beforehand on the inner wall of the inner case provided inside the antenna case 110, and at the time of assembling the antenna device 100, the flange portions 226E may be slid, fitted and fixed into the slits or the hook portions. In this instance, the parasitic element holder 208 is unnecessary.

Further, the patch antenna 200E in the third embodiment has a shape formed by bending the ends of the bent portions 224 of the parasitic element 220 in the first embodiment. Thus, with the parasitic element 220E including the flange portions 226, the height of the patch antenna 200E can be made small as compared with the height of the patch antenna 200 in the first embodiment in which the parasitic element 220 has no flange, the height being the length along the Z-axis direction and vertical to the upper surface of the radiating element 214. Hence, the design flexibility of the profile shape of the entire patch antenna can be improved.

Fourth Embodiment

Next, a fourth embodiment will be described. The fourth embodiment is an embodiment obtained by changing the parasitic element 220 and the ground plate 202 of the patch antenna 200 in the first embodiment. In the following, a similar configuration to those in the first embodiment to third embodiment described above will be provided with the same numeral, and a detailed description thereof will be omitted or simplified.

Patch Antenna

Figure 22:
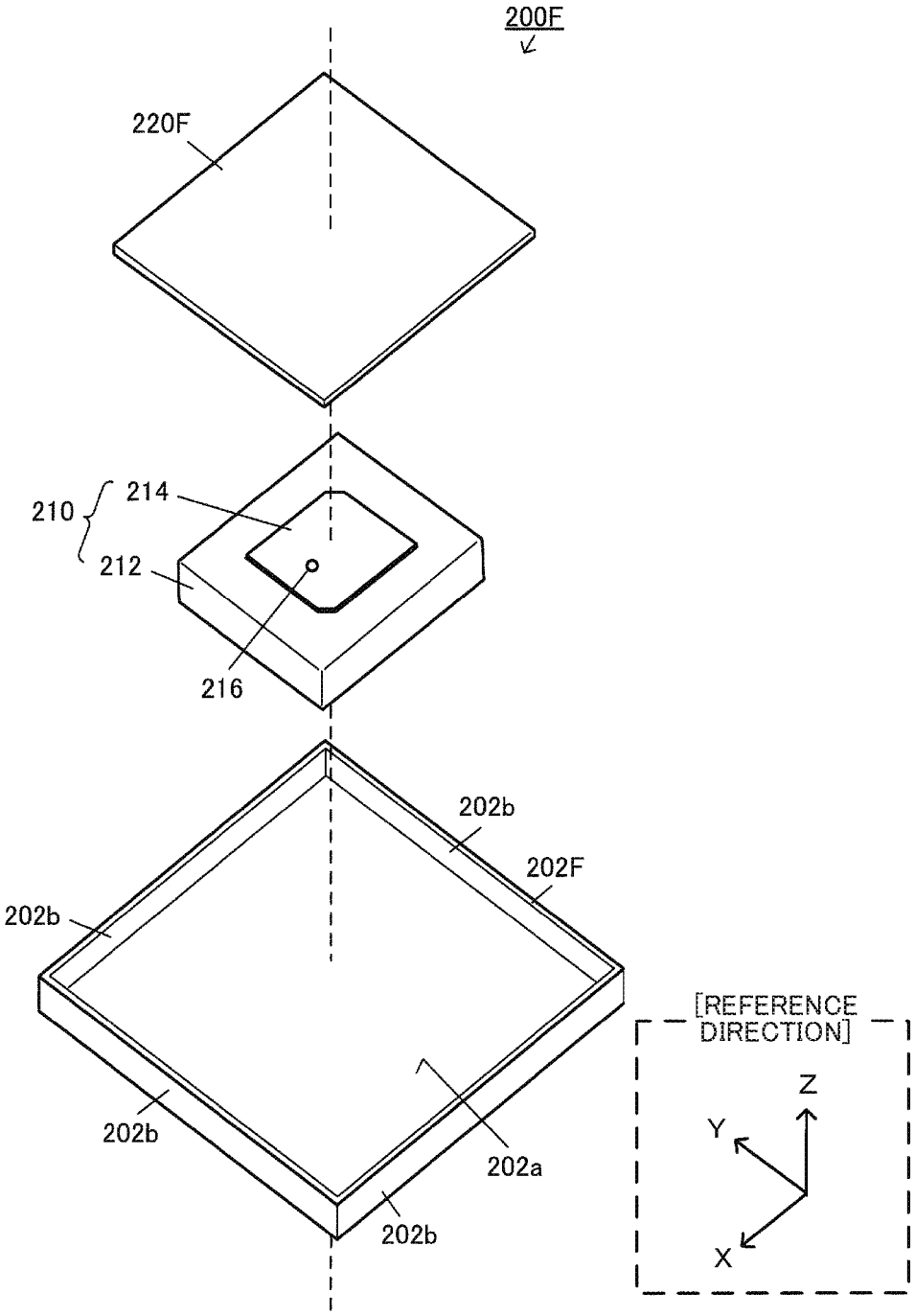
FIG. 22 is a perspective view of a patch antenna in a fourth embodiment.

FIG. 22 is a main configuration views of the patch antenna 200F in the fourth embodiment. FIG. 22 illustrates a ground plate 202F being a main member of the patch antenna 200F, the antenna main body 210, and a parasitic element 220F with the interval there among enlarged.

The ground plate 202F is provided in a position apart from the dielectric body 212, on the lower surface side that is a second surface side opposite to a first surface of the dielectric body 212 provided with the radiating element 214. In other words, the dielectric body 212 is provided in a position apart from the ground plate 202F with the second surface side facing the ground plate 202F, the second surface side being opposite to the upper surface being a first surface of the dielectric body 212 provided with the radiating element 214. The ground plate 202F has a bottom-view area wider than that of the dielectric body 212 in bottom view as seen from the Z-axis negative direction being the lower surface side of the dielectric body 212 toward the Z-axis positive direction, and the ground plate 202F is provided in a position to cover the dielectric body 212 in the bottom view.

The ground plate 202F is a metal member in a three-dimensional shape forming the shape of an open top box with a small depth. Specifically, the ground plate 202F includes a substantially quadrangular bottom portion 202*a* being a sheet parallel to the dielectric body 212 and wall portions 202*b* provided by raising them at four sides of the bottom portion 202*a*.

The parasitic element 220F has the same configuration as that of the parasitic element 220X in the first embodiment. The parasitic element 220F has a planar-view area wider than that of the radiating element 214 in a planar view that is a viewpoint of the patch antenna 200E as seen from the Z-axis positive direction being the first surface side of the dielectric body 212, and the parasitic element 220F is provided in a position to cover the radiating element 214 in the planar view.

Test Results

Figure 23:
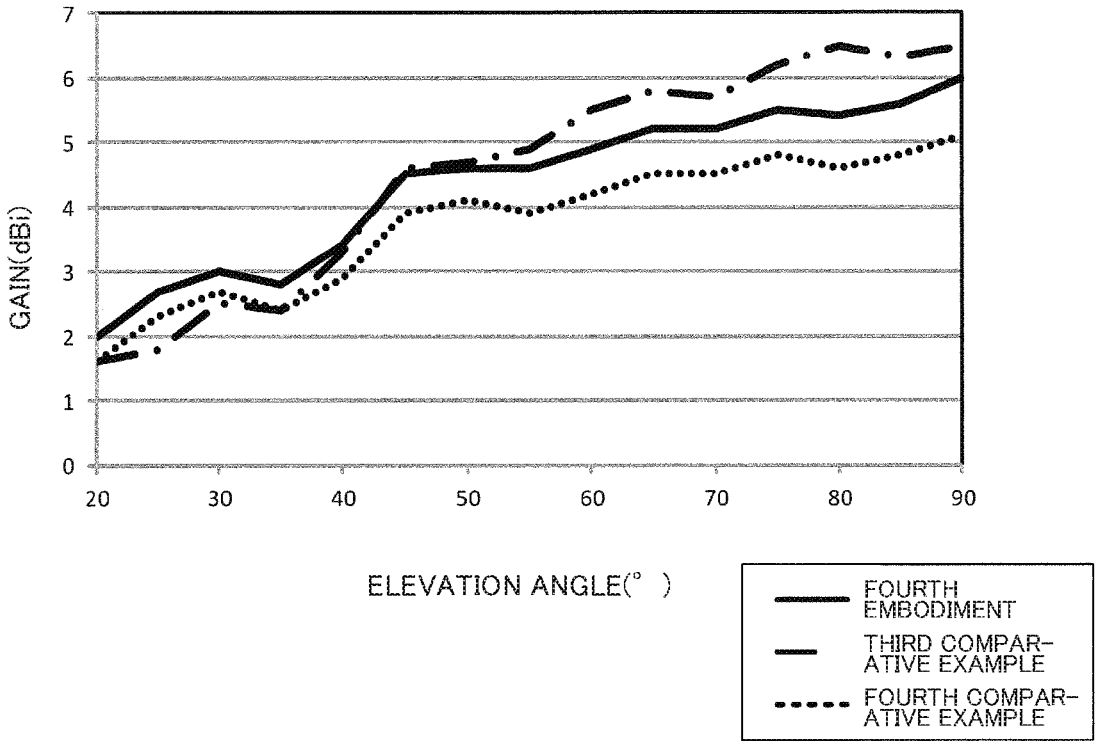
FIG. 23 is a gain characteristic graph of the patch antenna in the fourth embodiment.

Subsequently, the effects of the patch antenna 200F in the fourth embodiment will be described. FIG. 23 indicates a horizontal plane average gain obtained when the patch antenna 200F received a circularly polarized wave of 2332.5 [MHz]. As for the elevation angle being the horizontal axis, the direction of the XY-plane as seen from the origin of the patch antenna 200F is taken as 0 degree, and the Z-axis positive direction is taken as 90 degrees. Further, as comparative examples, antenna gains of two types of patch antennas, in each of which the configuration of the ground plate is made different from that in the fourth embodiment, are also indicated as a third comparative example and a fourth comparative example. A solid line indicates the antenna gain in the fourth embodiment, a dashed-dotted line indicates an antenna gain in a third comparative embodiment, and a dotted line indicates the antenna gain in the fourth comparative embodiment.

The patch antenna in the third comparative embodiment has a configuration in which the ground plate 202F of the patch antenna 200F in the fourth embodiment is a ground plate made of a plate-like metal sheet. Similarly to the fourth embodiment, the ground plate in the third comparative embodiment has a bottom-view area wider than that of the dielectric body 212 in bottom view as seen from the Z-axis negative direction being the lower surface side of the dielectric body 212 to the Z-axis positive direction, and the ground plate is provided in a position to cover the dielectric body 212 in the bottom view.

Further, the test was conducted assuming that the surface area of the ground plate in the third comparative embodiment was the same as the surface area of the ground plate 202F in the fourth embodiment. In other words, the test was conducted assuming that a bottom-view area of the ground plate 202F obtained in the case of flatly developing the four wall portions 202*b* thereof on the same plane as the bottom portion 202*a* was the same as the bottom-view area of the ground plate in the third comparative embodiment.

The patch antenna in the fourth comparative embodiment has a configuration in which the ground plate 202F of the patch antenna 200F in the fourth embodiment is a plate-like metal sheet. Similarly to the fourth embodiment and the third comparative embodiment, the ground plate in the fourth comparative embodiment has a bottom-view area wider than that of the dielectric body 212 in the bottom view as seen from the Z-axis negative direction being the lower surface side of the dielectric body 212 to the Z-axis positive direction, and the ground plate is provided in a position to cover the dielectric body 212 in the bottom view.

However, the bottom-view area of the surface area of the ground plate in the fourth comparative embodiment is smaller than that of the ground plate in the third comparative embodiment and is smaller than the bottom portion 202*a* of the surface area of the ground plate 202F in the fourth embodiment According to FIG. 23, in the range of the elevation angle equal to or greater than 50 degrees, the antenna gain is higher in the order of the third comparative embodiment, the fourth embodiment, and the fourth comparative embodiment. The antenna gain is higher in the descending order of the bottom-view area. On the other hand, when attention is focused on the range of the elevation angle equal to or smaller than 45 degrees, the antenna gain is higher in the fourth embodiment than in the third comparative embodiment and the fourth comparative embodiment. It can also be said that as long as the area of the bottom portion 202*a* can be ensured for obtaining the antenna gain required for the elevation angle, the antenna gain does not deteriorate even when the wall portions 202*b* are provided, and the antenna gain is rather improved in the range of the elevation angle equal to or smaller than 45 degrees. Thus, as long as the bottom portion 202*a* is provided for obtaining the antenna gain required as the ground plate, it is possible to form the ground plate into a three-dimensional shape and enhance the design flexibility of the profile shape of the entire patch antenna.

Modified Example

Although the parasitic element 220F has been the plate-like metal sheet in the fourth embodiment, it may be configured such that the parasitic element 220F is replaced with the parasitic element in the first to third embodiments described above.

Modified Examples of First to Fourth Embodiments

The aspects of the present disclosure are not limited to the above embodiments. Various modifications and variations may be made without departing from the provided subject matter.

(A) Shape of Radiating Element

For example, the radiating element 214 has been described as having the substantially quadrangular shape in the first to fourth embodiments described above, the radiating element 214 may have a circular shape or an elliptical shape. In this instance, the maximum outer dimension $\alpha$ of the radiating element 214 is a diameter in the circular shape and a long diameter in the elliptical shape.

According to each of the embodiments and the modified example described above, following aspects can be described.

In accordance with one of some aspects, there is provided a patch antenna comprising: a parasitic element; a dielectric body provided with a first surface facing to the parasitic element; and a radiating element provided on the first surface, and in the patch antenna, the parasitic element includes a three-dimensionally shaped metal material having a planar-view area wider than a planar-view area of the radiating element in a planar view as seen from the first surface side of the dielectric body, and is provided in a position apart from the radiating element and to cover the radiating element in a planar view.

As a result, in some aspects, the parasitic element may have a planar-view area wider than a planar-view area of the radiating element in a planar view and be provided in a position apart from the radiating element and to cover the radiating element in a planar view, and can include a three-dimensionally shaped metal material. Since the parasitic element can be formed in the three-dimensional shape, it is possible to improve the design flexibility of the patch antenna, such as being able to design the profile shape of the entire patch antenna in accordance with the shape of the accommodation space.

In accordance with one of some aspects, there is provided the patch antenna, wherein the parasitic element may have a convex shape toward a viewpoint of the planar view.

As a result, in some aspects, the parasitic element can be configured so as to have a convex shape toward the viewpoint of the planar view. By forming the parasitic element in the convex shape toward the viewpoint of the planar view, the area seen from the planar view can be made small to enable improvement in design flexibility of the patch antenna.

In accordance with one of some aspects, there is provided the patch antenna, wherein the convex shape may be a bent shape formed to have one or more inclined portions.

As a result, in some aspects, the bent shape is formed to have one or more inclined portions, thereby facilitating shaping of the parasitic element in the convex shape.

In accordance with one of some aspects, there is provided the patch antenna, wherein the convex shape may be an arch shape.

As a result, in some aspects, the parasitic element can be formed into the arch shape.

In accordance with one of some aspects, there is provided the patch antenna, wherein the parasitic element may include a flange portion.

As a result, in some aspects, the parasitic element including the flange portion, thereby facilitating installation of the parasitic element. Further, in comparison between the parasitic element with the flange portion and a radiating element without the flange portion as parasitic elements having similar gain characteristics, the vertical height with respect to the upper surface of the radiating element can be reduced more in the parasitic element with the flange portion.

In accordance with one of some aspects, there is provided the patch antenna, wherein in a direction vertical to an upper surface of the radiating element, a shortest distance from a parallel plane which is parallel to the upper surface of the radiating element to the parasitic element, in a case of assuming a distance between the upper surface and the parallel plane to be zero, may be equal to or smaller than twice the maximum outer dimension of the radiating element in the planar view.

In accordance with one of some aspects, there is provided the patch antenna, wherein the shortest distance may be equal to or greater than 0.18 times and equal to or smaller than 0.59 times the maximum outer dimension.

As a result, in some aspects, the shortest distance from the parallel plane which is parallel to the upper surface of the radiating element to the parasitic element, in the case of assuming a distance between the upper surface and the parallel plane which is on the upper surface to be zero, can be made equal to or smaller than twice the maximum outer dimension of the radiating element, and further equal to or greater than 0.18 times and equal to or smaller than 0.59 times the maximum outer dimension.

In accordance with one of some aspects, the patch antenna may further include a ground plate provided apart from a second surface of the dielectric body, the second surface being opposite to the first surface, and in the patch antenna, the ground plate includes a three-dimensionally shaped metal material having a bottom-view area wider than a bottom-view area of the dielectric body in bottom view as seen from the second surface side of the dielectric body and is provided in a position to cover the dielectric body in the bottom view.

In accordance with one of some aspects, there is provided a patch antenna comprising: a ground plate; a dielectric body provided in a position apart from the ground plate with a second surface facing to the ground plate; and a radiating element provided on a first surface of the dielectric body, the first surface being opposite to the second surface, and in the patch antenna, the ground plate includes a three-dimensionally shaped metal material having a bottom-view area wider than a bottom-view area of the dielectric body in a bottom view as seen from the second surface side of the dielectric body and is provided in a position to cover the dielectric body in the bottom view.

As a result, in some aspects, the ground plate provided in the patch antenna can be formed to have the three-dimensionally shaped metal material with a bottom-view area wider than a bottom-view area of the dielectric body in bottom view. Since the ground plate can be formed in the three-dimensional shape, it is possible to improve the design flexibility of the patch antenna, such as being able to design the profile shape of the entire patch antenna in accordance with the shape of the accommodation space.

According to the above aspects, it is possible to enhance flexibility of a profile shape of a patch antenna, provided with a parasitic element, as a whole at the time of designing the patch antenna.

What is claimed is:

1. A patch antenna comprising:

a parasitic element;

a dielectric body provided with a first surface facing to the parasitic element; and a radiating element provided on the first surface, wherein the parasitic element includes a three-dimensionally shaped metal material having a planar-view area wider than a planar-view area of the radiating element in a planar view as seen from the first surface side of the dielectric body, and is provided in a position apart from the radiating element and to cover the radiating element in a planar view, and in a direction vertical to an upper surface of the radiating element, a shortest distance from a parallel plane which is parallel to the upper surface of the radiating element to the parasitic element, in a case of assuming a distance between the upper surface and the parallel plane to be zero, is equal to or smaller than twice a maximum outer dimension of the radiating element in the planar view.

2. The patch antenna according to claim 1, wherein the convex shape is a bent shape formed to have one or more inclined portions.

3. The patch antenna according to claim 2, wherein in a direction vertical to an upper surface of the radiating element, a shortest distance from a parallel plane which is parallel to the upper surface of the radiating element to the parasitic element, in a case of assuming a distance between the upper surface and the parallel plane to be zero, is equal to or smaller than twice a maximum outer dimension of the radiating element in the planar view.

4. The patch antenna according to claim 3, wherein the shortest distance is equal to or greater than 0.18 times and equal to or smaller than 0.59 times the maximum outer dimension.

5. The patch antenna according to claim 1, wherein the convex shape is an arch shape.

6. The patch antenna according to claim 5, wherein in a direction vertical to an upper surface of the radiating element, a shortest distance from a parallel plane which is parallel to the upper surface of the radiating element to the parasitic element, in a case of assuming a distance between the upper surface and the parallel plane to be zero, is equal to or smaller than twice a maximum outer dimension of the radiating element in the planar view.

7. The patch antenna according to claim 6, wherein the shortest distance is equal to or greater than 0.18 times and equal to or smaller than 0.59 times the maximum outer dimension.

8. The patch antenna according to claim 1, wherein the parasitic element includes a flange portion.

9. The patch antenna according to claim 1, wherein the shortest distance is equal to or greater than 0.18 times and equal to or smaller than 0.59 times the maximum outer dimension.

10. The patch antenna according to claim 9, further comprising a ground plate provided apart from a second surface of the dielectric body, the second surface being opposite to the first surface, wherein the ground plate includes a three-dimensionally shaped metal material having a bottom-view area wider than a bottom-view area of the dielectric body in a bottom view as seen from the second surface side of the dielectric body, and is provided in a position to cover the dielectric body in the bottom view.

11. The patch antenna according to claim 1, further comprising a ground plate provided apart from a second surface of the dielectric body, the second surface being opposite to the first surface, wherein the ground plate includes a three-dimensionally shaped metal material having a bottom-view area wider than a bottom-view area of the dielectric body in a bottom view as seen from the second surface side of the dielectric body, and is provided in a position to cover the dielectric body in the bottom view.

12. The patch antenna according to claim 1, further comprising a ground plate provided apart from a second surface of the dielectric body, the second surface being opposite to the first surface, wherein the ground plate includes a three-dimensionally shaped metal material having a bottom-view area wider than a bottom-view area of the dielectric body in a bottom view as seen from the second surface side of the dielectric body, and is provided in a position to cover the dielectric body in the bottom view.

13. A patch antenna comprising:

a parasitic element;

a dielectric body provided with a first surface facing to the parasitic element; and a radiating element provided on the first surface, wherein the parasitic element includes a three-dimensionally shaped metal material having a planar-view area wider than a planar-view area of the radiating element in a planar view as seen from the first surface side of the dielectric body, and is provided in a position apart from the radiating element and to cover the radiating element in a planar view, the parasitic element includes a planar portion facing the radiating element, and two bent portions facing with each other, and each of the two bent portions bends over an angle of 90 degrees with respect to the planar portion, such that each of the two bent portions extends toward a direction opposite to a direction toward the radiating element, and extends toward a center of the planar portion.

14. The patch antenna according to claim 13, wherein the parasitic element includes a flange portion.

15. The patch antenna according to claim 13, wherein in a direction vertical to an upper surface of the radiating element, a shortest distance from a parallel plane which is parallel to the upper surface of the radiating element to the parasitic element, in a case of assuming a distance between the upper surface and the parallel plane to be zero, is equal to or smaller than twice a maximum outer dimension of the radiating element in the planar view.

16. The patch antenna according to claim 15, wherein the shortest distance is equal to or greater than 0.18 times and equal to or smaller than 0.59 times the maximum outer dimension.

17. The patch antenna according to claim 13, further comprising a ground plate provided apart from a second surface of the dielectric body, the second surface being opposite to the first surface, wherein the ground plate includes a three-dimensionally shaped metal material having a bottom-view area wider than a bottom-view area of the dielectric body in a bottom view as seen from the second surface side of the dielectric body, and is provided in a position to cover the dielectric body in the bottom view.

18. A patch antenna comprising:

a ground plate;

a dielectric body provided in a position apart from the ground plate with a second surface facing to the ground plate; and a radiating element provided on a first surface of the dielectric body, the first surface being opposite to the second surface, wherein the ground plate includes a three-dimensionally shaped metal material having a bottom portion and a wall portion protruding from a side of the bottom portion, the bottom portion including a bottom-view area wider than a bottom-view area of the dielectric body in a bottom view as seen from the second surface side of the dielectric body, and the bottom portion being provided in a position to cover the dielectric body in the bottom view.

19. The patch antenna according to claim 18, wherein the three-dimensionally shaped metal material has a shape of an open top box, the three-dimensionally shaped metal material further has at least another wall portion protruding from at least another side of the bottom portion, and the wall portion and the at least another wall portion protrude from sides of the bottom portion respectively.

20. The patch antenna according to claim 19, wherein the bottom portion has a quadrangular shape, and the wall portion and the at least another wall portion are a first wall portion, a second wall portion, a third wall portion, and a fourth wall portion, each protruding from each side of the quadrangular shape.

21. A patch antenna comprising:

a parasitic element;

a dielectric body provided with a first surface facing to the parasitic element; and a radiating element provided on the first surface, wherein the parasitic element has a convex shape protruding toward a direction opposite to a direction toward the radiating element, the parasitic element includes a three-dimensionally shaped metal material having a planar-view area wider than a planar-view area of the radiating element in a planar view as seen from the first surface side of the dielectric body, and is provided in a position apart from the radiating element and to cover the radiating element in a planar view, and in a direction vertical to an upper surface of the radiating element, a shortest distance from a parallel plane which is parallel to the upper surface of the radiating element to the parasitic element, in a case of assuming a distance between the upper surface and the parallel plane to be zero, is equal to or smaller than twice a maximum outer dimension of the radiating element in the planar view.

* * * * *